US007432858B2

(12) United States Patent
Arndt et al.

(10) Patent No.: US 7,432,858 B2
(45) Date of Patent: Oct. 7, 2008

(54) PRINTED CIRCUIT BOARD WIRELESS ACCESS POINT ANTENNA

(75) Inventors: David L. Arndt, Duluth, GA (US); Donald L. Runyon, Jr., Duluth, GA (US); Sara Ellen K. Phillips, Alpharetta, GA (US)

(73) Assignee: Andrew Corporation, Westchester, IL (US)

( * ) Notice: Subject to any disclaimer, the term of this patent is extended or adjusted under 35 U.S.C. 154(b) by 202 days.

(21) Appl. No.: 11/082,363

(22) Filed: Mar. 17, 2005

(65) Prior Publication Data

US 2005/0206569 A1 Sep. 22, 2005

Related U.S. Application Data

(60) Provisional application No. 60/553,883, filed on Mar. 17, 2004.

(51) Int. Cl.
*H01Q 1/38* (2006.01)

(52) U.S. Cl. ..... 343/700 MS

(58) Field of Classification Search ..... 343/700 MS, 343/872, 873, 907, 878; 340/541
See application file for complete search history.

(56) References Cited

U.S. PATENT DOCUMENTS

| | | | | |
|---|---|---|---|---|
| 3,364,491 | A | 1/1968 | Stohr | |
| 5,619,217 | A * | 4/1997 | Mailandt et al. | 343/872 |
| 6,043,794 | A | 3/2000 | Faulkner et al. | |
| 6,295,063 | B1 * | 9/2001 | Minami et al. | 345/419 |
| 6,351,246 | B1 | 2/2002 | McCorkle | |
| 6,369,766 | B1 | 4/2002 | Strickland | |

(Continued)

FOREIGN PATENT DOCUMENTS

| | | |
|---|---|---|
| EP | 0 766 343 A2 | 2/1997 |

(Continued)

OTHER PUBLICATIONS

Wide-Band Planar Monopole Antennas. Agrawall, Narayan Prasad; Kumar, Girish and Ray, K.P. IEEE Transactions on Antennas and Propagation, vol. 46, No. 2, Feb. 1998. pp. 294-295.

(Continued)

*Primary Examiner*—Huedung Mancuso
(74) *Attorney, Agent, or Firm*—Michael J. Mehrman; Mehrman Law Office P.C.

(57) ABSTRACT

A substantially planar antenna configured for easy installation in a ceiling or ceiling tile. The antenna is configured for duplex communications in carrier frequency ranges spanning at least a 2:1 ratio of frequency values from the highest to the lowest frequency in the carrier frequency band, such as the frequency range from 800 to 960 MHz and 1700 to 2400 MHz, and within a coverage pattern below the ceiling extending through 360° azimuth and 180° elevation. The antennas are manufactured as a printed circuit board that snaps apart into a number of panels, which each contains at least a planar antenna element and a cross brace that are used to assemble the antenna. The printed circuit board is a dielectric substrate carrying printed conductor including a radiating circular monopole disc radiating element, associated transmission signal paths, and printed indicia that typically include assembly instructions and a logo. The printed circuit board sheet configuration makes the antennas inexpensive to mass produce and easy to snap apart into individual units, which are themselves self-contained, easy to snap apart and install.

22 Claims, 20 Drawing Sheets

U.S. PATENT DOCUMENTS

| | | | | |
|---|---|---|---|---|
| 6,563,465 | B2 * | 5/2003 | Frecska | 343/700 MS |
| 6,642,899 | B2 | 11/2003 | Strickland | |
| 6,922,145 | B2 * | 7/2005 | Piesinger | 340/541 |
| 2002/0050955 | A1 | 5/2002 | Strickland | |
| 2002/0053994 | A1 | 5/2002 | McCorkle | |
| 2002/0175876 | A1 | 11/2002 | Schantz | |
| 2002/0180642 | A1 | 12/2002 | Frecska | |
| 2003/0034932 | A1 * | 2/2003 | Huebner et al. | 343/795 |
| 2003/0210207 | A1 | 11/2003 | Sup | |
| 2004/0017314 | A1 | 1/2004 | Petropolous | |
| 2004/0125020 | A1 | 7/2004 | Hendler | |
| 2006/0055616 | A1 * | 3/2006 | Heyde et al. | 343/828 |

FOREIGN PATENT DOCUMENTS

| | | |
|---|---|---|
| EP | 1 182 731 | 2/2002 |
| JP | 09 238012 | 9/1997 |
| WO | 96-38881 | 12/1996 |
| WO | WO 02/093690 A1 | 11/2002 |
| WO | WO 2004/073112 A1 | 8/2004 |

OTHER PUBLICATIONS

Planar Trapezoidal and Pentagonal Monopoles with Impedance Bandwidths in Excess of 10:1. Evans, J.A. and Ammann, M.J. Dept. Electronic & Communications Engineering, Dublin Institute of Technology, Kevin St., Dublin 8, Ireland. 4 pages.

Experiments on Input Impedance of Tilted Planar Monopole Antenna. Chen, Zhi Nlng. Microwave and Optical Technology Letters, vol. 26, No. 3, Aug. 5, 2000. pp. 202-204.

Broadband planar monopole antenna. Chen, Z.N. IEE Proc.-Microw. Antennas Propag., vol. 147, No. 6, Dec. 2000. pp. 526-528.

Annular planar monopole antennas. Chen, Z.N.; Ammann, M.J., Chia, M.Y.W. and See, T.S.P. IEE proc.-Microw. Antennas Propag., vol. 149, No. 4, Aug. 2002. pp. 200-203.

Impedance characteristics of EMC triangular planar monopoles. Chen, Zhi Ning and Chia, M.YW. Electronics Letters, Oct. 11, 2001, vol. 37, No. 21. pp. 1271-1272.

Impedance characteristics of Trapezoidal Planar Monopole Antennas. Chen, Zhi Ning and Chia, Y.W.M. Microwave and Optical Technology Letters, vol. 27, No. 2, Oct. 20, 2000. pp. 120-122.

Planar Elliptical Element Ultra-Wideband Dipole Antennas. Schantz, Hans Gregory. Time Domain Corporation, 7057 Old Madiwon Pike, Huntsville, AL 35806. pp. 44-47.

Impedance characteristics of planar bow-tie-like monopole antennas. Chen, Zhi Ning. Electronics Letters, Jun. 22, 2000, vol. 36, No. 13. pp. 1100-1101.

Broadband Monopole Antenna With Parasitic Planar Element. Chen, Zhi Ning and Chia, Y.W.M. Microwave and Optical Technology Letters, vol. 27, No. 3, Nov. 5, 2000. pp. 209-210.

A New Wide Band Planar Antenna. Hongjian, Wang; Benqing, Gao, Shiming, Yang. Department of Electrical Engineering, Beijing Institute of Technology, Beijing, 100081. 4 pages.

I-ceilings Wireless Systems Antnena Panel Product Literature. Armstrong World Industries, Inc. 2 pages.

New Wideband Monopole Antennas. Agrawall, Narayan Prasad; Kumar, Girish and Ray, K.P. pp. 248-251.

* cited by examiner

Model 1 Geometry

Disc monopole, Model 1 (Flat) Ground Plane, Pattern Cut in Plane of Radiator

Disc monopole, Model 1 (Flat) Ground Plane, Pattern Cut in Plane Perpendicular to Radiator Model 2 Geometry (120° included angle)

Disc monopole, Model 2 Ground Plane, Pattern Cut in Plane of Radiator

Disc monopole, Model 2 Ground Plane, Pattern Cut in Plane Perpendicular to Radiator Complex Impedence of Model 1 and 2 (Zo=R+jX) For Finite Ground Plane Complex Impedence of Model 1 and 2 (Zo=R+jX)

PRINTED CIRCUIT BOARD WIRELESS ACCESS POINT ANTENNA

REFERENCE TO RELATED APPLICATIONS

This Application claims priority to U.S. Provisional Application Ser. No. 60/553,883 entitled "Wide-band Communication Access Point" filed on Mar. 17, 2004.

FIELD OF THE INVENTION

This Invention pertains to wireless communication systems and more particularly, to an antenna for a wireless communication device, such as a wireless repeater or access point, intended for indoor ceiling mounting.

BACKGROUND

In recent years, the proliferation of wireless devices has created a need for support devices, such as wireless repeaters and access points, to maintain service coverage in indoor locations. Virtually every cellular telephone user has experienced a loss or degradation of service in certain indoor locations, particularly in home and business locations. The reduction in communication coverage or signal strength also causes the cellular telephone to increase its transmit power, which quickly drains the battery. To correct this problem, wireless repeaters can be deployed to improve indoor communication reception. These devices are typically mounted in a convenient place and connected by a coaxial cable to an antenna to improve communication signal strength in a desired location. Antennas are in constant demand for wireless repeaters, and those that are low cost, easy to install and aesthetically pleasing have considerable advantages. The same type of antenna, besides being used with a wireless repeater, may also be used as for as a wireless access point, a wireless Internet node, as part of a local area network (LAN) and with various kinds of other indoor communication devices.

Wireless telephone systems operate at a number of carrier frequencies, such as the analog cellular carrier frequency band between 824 MHz and 894 MHz, and the PCS and GSM digital system carrier frequency bands of 1850 MHz through 1990 MHz in the United States and 1710 MHz through 2170 MHz in Europe and Japan. Wireless Internet nodes and wireless LAN access points can operate at higher carrier frequencies, such as the WiFi band near 2400 MHz. As a result, it is advantageous for one access point antenna to operate acceptably throughout a relatively wide frequency bandwidth so that the same antenna can be used for all available wireless communication applications, now generally in the range from approximately 800 MHz through 2400 MHz. Unfortunately, conventional wireless access points do not have this bandwidth capability. These antennas should also provide good omni-directional reception, which for a ceiling mounted antenna amounts to approximately 360° azimuth and 180° elevation coverage below the ceiling.

For example, U.S. Pat. No. 6,369,766 to Strickland et al. (assigned to the assignee of the present application) describes an omni-directional antenna having an asymmetrical bi-cone as a passive feed for a antenna element. This relatively low profile antenna achieves good performance and excellent coverage. Like other known conventional antennas designed for indoor use, however, this antenna only operates at a narrow frequency bandwidth about the 2400 MHz standard for wireless Internet nodes and LAN access points, and therefore cannot also accommodate wireless telephone service.

One recent attempt to provide an indoor antenna with wider bandwidth is the monopole antenna offered by Huber and Suhner, Inc. This antenna is designed for suspension beneath a ceiling and the radiating element has a non-planar shape. The profile of the radiating element when viewed from the front has a geometric shape similar to a tree or tree leaf and, when viewed from the side, has a serpentine shape, such that the overall shape of the antenna element is decidedly three-dimensional. The eccentric three-dimensional shape of this antenna is relatively expensive to construct and tends to draw distracting attention to the antenna.

Many indoor antennas have other eccentric shapes that are similarly expensive to construct, ungainly and obtrusive. Often, such antennas also have a somewhat delicate antenna element that needs to be protected from damage by inadvertent contact. To conceal and protect these antennas, they are typically placed within an electrically-transparent, but often visually opaque, radome. The radome adds to the bulk, complexity and cost of the antenna. As a result, a continuing need exists for a wide-band, low cost, easy to install and aesthetically pleasing indoor antenna that does not require a radome.

SUMMARY OF THE INVENTION

The needs described above are met in an antenna designed to be assembled and easily installed in a ceiling, such as a conventional ceiling tile or drywall ceiling. The antenna can be manufactured with some of its parts, typically at least an antenna element and an associated cross brace, contained on a printed circuit board (PCB) panel that snaps apart into pieces used to assemble the antenna. The panel may be manufactured as a printed circuit board repeat pattern on a printed circuit board sheet that snaps apart into individual antenna panel units. The individual antenna panels, in turn, have snap apart pieces that can be assembled on site and then installed at the desired location. This configuration makes the antenna element and cross brace inexpensive to mass produce, while also making the antenna easy to assemble and install in the field without the need for tools other than a device to cut the opening in the ceiling. For installation in a conventional tile or drywall ceiling, for example, a standard utility knife is typically sufficient to do the job.

Each antenna may also be packaged as a self-contained unit including the snap-apart panel, a ground plate, a cable connector and an optional trim piece that fits over the antenna element and conceals the hole in the ceiling. To facilitate assembly and installation of the antenna in the field, the antenna element may also contain printed indicia including assembly instructions and perhaps a logo. This makes the self-contained antenna unit easy to assemble and install in the field with a minimum of tools, as described above.

The antenna generally includes a fin-shaped antenna element containing a printed circuit monopole conductive radiating element sandwiched between two dielectric boards. The antenna element also includes associated printed circuit transmission signal paths. The fin-shaped antenna element is unobtrusive and has an aesthetically pleasing appearance. The dielectric boards also protect the printed circuit radiating element and associated transmission signal paths, and thereby results in a sturdy assembly that avoids the need for a separate radome to cover the antenna element. This solves many of the problems associated with conventional ceiling-mounted wireless access point antennas.

The antenna also exhibits exceptional operational characteristics that improve greatly over other available ceiling-mounted wireless antennas. When installed in the ceiling, in particular, the antenna operates for duplex communications within a carrier frequency range from approximately 800 MHz through 2400 MHz to allow the same antenna to be used with currently available PCS, GSM and WiFi systems. The antenna also operates within a coverage pattern below the ceiling extending through approximately 360° azimuth and 180° elevation so that good reception is achieved throughout the room in which the antenna is installed.

It should also be appreciated that many indoor antennas minimize the size of an associated ground plate for aesthetics and cover the ground plate with a radome because the ground plate is located below the ceiling. The antenna in the present invention locates the ground plate above a ceiling, which allows a larger and more effective ground plate to be used to increase the antenna gain and to direct the energy in a desired direction away from the antenna location without impacting the aesthetic appearance of the antenna.

The invention generally includes a substantially planar antenna element is perpendicularly connected to the ground plate and the ground plate is configured to be positioned above an opening in the ceiling and with the antenna element extending through the opening in the ceiling and at least partially suspended below the ceiling. When the antenna is assembled in the operational configuration, the antenna operates for duplex communications within a coverage pattern below the ceiling extending through approximately 360° azimuth and 180° elevation when the antenna is assembled in the operational configuration.

In a particular embodiment, the ground plate includes a slot for receiving the antenna element. The antenna element is inserted through the slot so that it extends through the ground plate and through the opening in the ceiling. The antenna element also includes ratchet teeth on its edges and associated strain relief openings adjacent to the ratchet teeth for engaging the slot to hold the antenna element to the ground plate. Alternatively, the antenna element may attach to the ground plate with snap-in feet or another suitable attachment device without extending the antenna element through the ground plate. The antenna element and the cross brace may snap apart from a printed circuit board panel so that the antenna can be easily assembled and installed in the field. The antenna element may also carry printed indicia including assembly instructions for the antenna, and an optional trim piece can be installed over a portion of the antenna element to conceal the opening in the ceiling when the antenna is assembled in the operational configuration.

Operationally, the antenna is configured for duplex communications in a carrier frequency range spanning at least an approximate 2:1 ratio from the highest frequency value to the lowest frequency value in the carrier frequency band when the antenna is assembled in the operational configuration. For example the antenna in a carrier frequency range from approximately 800 MHz through 2400 MHz To achieve the desired operational and structural characteristics, the antenna element typically includes a printed circuit monopole conductor radiating element, and associated transmission signal paths in electrical communication with the radiating element, sandwiched between two dielectric boards. The antenna element may also include a printed circuit secondary ground plate carried on an exterior surface of at least one of the dielectric boards. For an application where a coaxial cable is used to connect the antenna into a LAN or other type communication network, the antenna would also have a coaxial cable connector in electrical communication with the printed circuit transmission signal paths, which are in turn in electrical communication with the radiating element. For example, the coaxial cable connector element may be carried on the antenna element itself to avoid the need for a secondary cable or other conductor between the antenna element and the coaxial cable connector.

Assembly of the inventive antenna may be implemented using a printed circuit board sheet that contains a repeat pattern of snap-apart panels with each panel containing snap-apart pieces that include at least a planar antenna element and a planar cross brace configured for insertion into a slot at a top end of the antenna element. The snap-apart pieces are configured for assembly of the antenna in its operational configuration with the antenna element attached to a ground plate located above the ceiling, the cross brace inserted through the slot and supporting the antenna element substantially perpendicular to the ground plate. The antenna element extends from the ground plate through an opening in the ceiling and a part of the antenna element is suspended below the ceiling.

The steps for installation of the antenna include snapping apart pieces from a flat panel that includes at least the antenna element and a cross brace, inserting the cross brace into a slot in the top end of the antenna element to support the antenna element being substantially perpendicular to the ground plate. Installation continues with the cutting of an opening in the ceiling, placing the ground plate having a slot over the opening in the ceiling, and attaching the planar antenna element to the ground plate and passing it through the opening in the ceiling to suspend the antenna element at least partially below the ceiling. A trim piece may also installed over a part of the antenna element to conceal the opening in the ceiling. As noted previously, this process allows the antenna to be assembled and installed in a ceiling without tools other than a cutting tool for creating the opening in the ceiling, such as a standard utility knife.

DETAILED DESCRIPTION OF THE PREFERRED EMBODIMENTS

Figure 1:
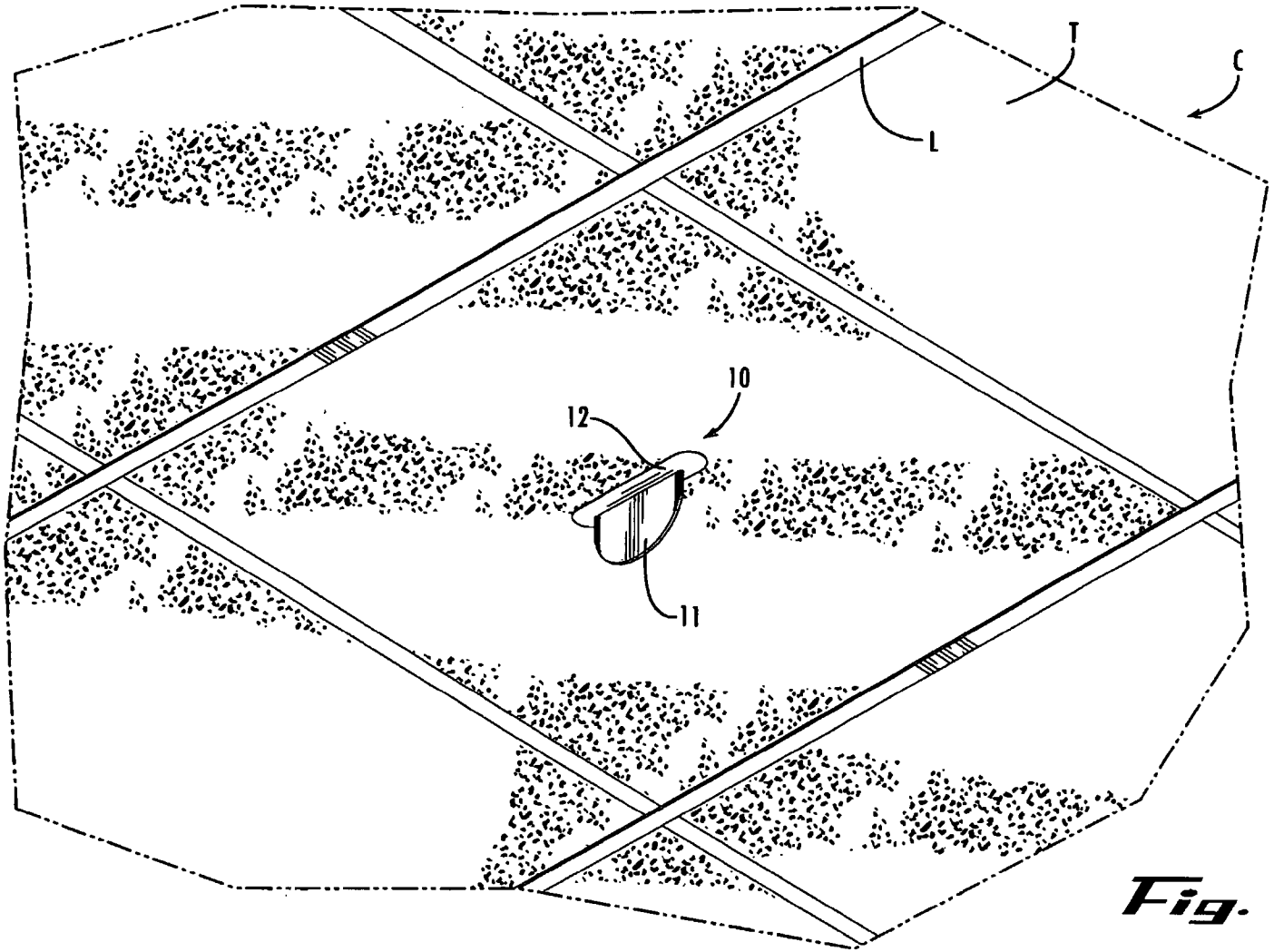
FIG. 1 is a perspective view of an antenna according to a preferred form of the invention, in particular showing such an antenna mounted to a ceiling.

The present invention may be embodied as an antenna configured for easy installation in a ceiling or ceiling tile, although it could be installed in other locations such as a vertical wall, floor, mast or any other suitable location. The antenna is typically configured to provide communication signal strength within generally accepted industry standards for duplex communications in carrier frequency ranges spanning at least an approximate 2:1 ratio of frequency values from the highest to the lowest frequency in the carrier frequency band. For example, a typical antenna is configured to operate in the frequency range from approximately 800 MHz to 2400 MHz. The antenna could, however, be deployed for simplex communications and configured for other operational ranges. The antenna is also configured to provide acceptable communication signal strength in a coverage pattern below the ceiling extending through approximately 360° azimuth and 180° elevation.

The antennas may advantageously be manufactured as a printed circuit board repeat pattern on a printed circuit board sheet that snaps apart into a number of panels with each panel containing parts used to assemble a single antenna. Although this fabrication technique is conducive to low cost for mass production, other manufacturing techniques could be used, such as injecting molding one or more of the pieces. In addition, each panel typically includes at least a snap-apart antenna element and an associated cross brace. The antenna panel may also be packaged together with a ground plate and an optional trim piece to create a self-contained antenna unit suitable for field assembly and installation. Of course, other packaging arrangements may be used.

In addition, the preferred printed circuit board is typically constructed as a dielectric substrate carrying printed conductor including a radiating circular monopole disc radiating element, associated transmission signal paths, and printed indicia including assembly instructions and perhaps a logo. In addition, the preferred antenna element includes a circular monopole disc radiating element sandwiched between two dielectric boards. Nevertheless, other antenna element configurations could be employed, such a dual polarization radiating element, a non-circular radiating element, a microstrip radiating element carried on one side of single dielectric board, a microstrip radiating element carried on one side of single dielectric board having a ground plate on a portion of the same or other side of the board, and so forth. The ground plate may be flat, folded or curved in various embodiments.

Referring now to the drawing figures, in which like reference numerals refer to like parts throughout the several views, FIGS. 1-4 show an antenna 10 installed in a conventional ceiling C. The ceiling C includes conventional array of modular ceiling tiles T, which are typically 2 feet (61 cm) square, supported by a grid or lattice L. The antenna 10 includes an antenna element 11, which in this embodiment carries a circular monopole disc radiating element (shown best in FIG. 6C) and associated transmission signal paths sandwiched between two dielectric boards. The dielectric boards form a sturdy construct that protects the radiating element. As a result, the antenna 10 does not need a radome to cover and protect the antenna element As shown best in FIG. 1, once installed the antenna element 11 extends downward from the ceiling tile and an optional trim piece 12 fits over the antenna element 11 adjacent the ceiling tile to conceal the opening in the ceiling tile that receives the antenna element 11. The antenna element 11 is relatively small in relation to the ceiling tile T, has an unobtrusive and aesthetically pleasing fin-like appearance without a radome covering the antenna element 11.

Figure 2:
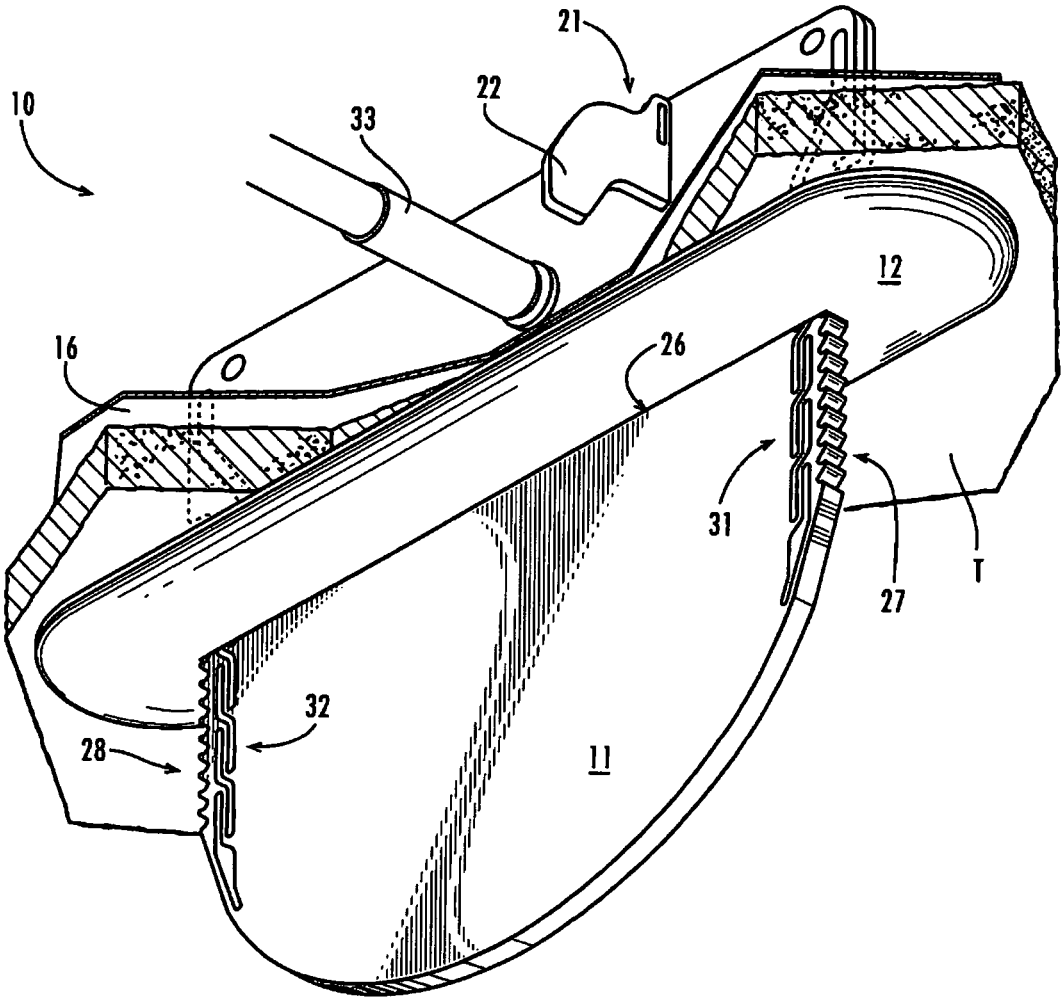
FIG. 2 is a perspective, detailed view of the antenna of FIG. 1 shown mounted to the ceiling.
Figure 3:
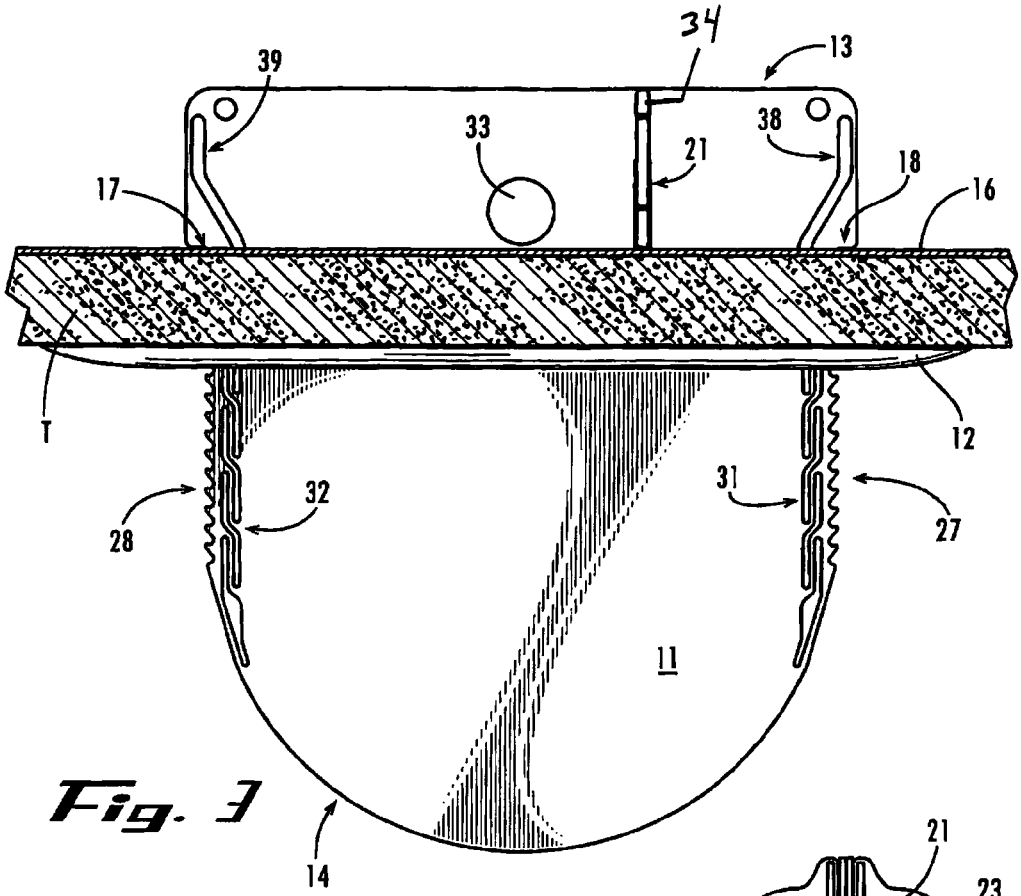
FIG. 3 is a front view of the antenna of FIG. 1 shown mounted to the ceiling.
Figure 4:
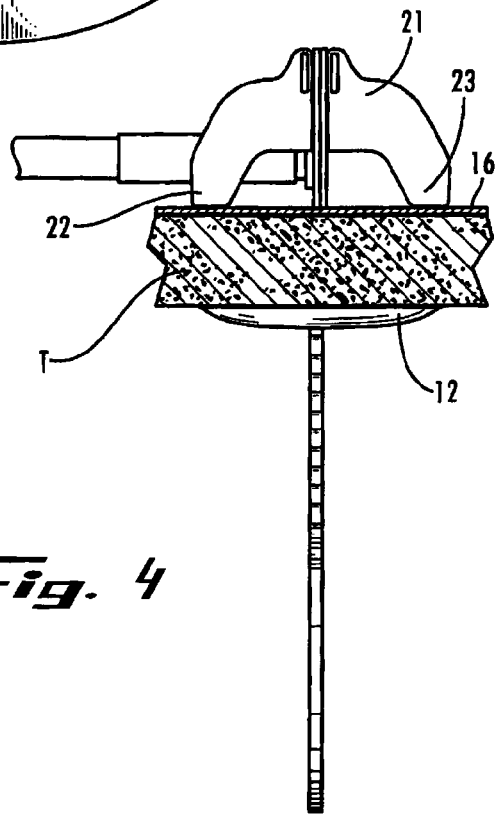
FIG. 4 is a side view of the antenna of FIG. 1 shown mounted to the ceiling.

FIGS. 2, 3 and 4, show the antenna 10 as installed in a ceiling in greater detail. The upper end 13 of the antenna element 11 is generally rectangular, while the bottom end 14 of the antenna element 11 has a smoothly rounded fin-shaped appearance. In this embodiment, the antenna element 11 extends through an aluminum ground plate 16 and through the ceiling tile T. The antenna element 11 also extends through an optional trim piece 12. The aluminum ground plate 16 can be of various sizes and thicknesses. One size and thickness that works rather well is 12 inches (30.48 cm) by 12 inches (30.48 cm), with a thickness of approximately $1/32^{nd}$ of an inch (0.08 cm). While a square shape is shown, other shapes could be employed. Antenna element 11 is supported atop the aluminum ground plate 16 by shoulders 17, 18 formed in the antenna element. The shoulders are sufficient to support the antenna element perpendicular to the ground plate and suspended at least partially below the ceiling.

Figure 14:
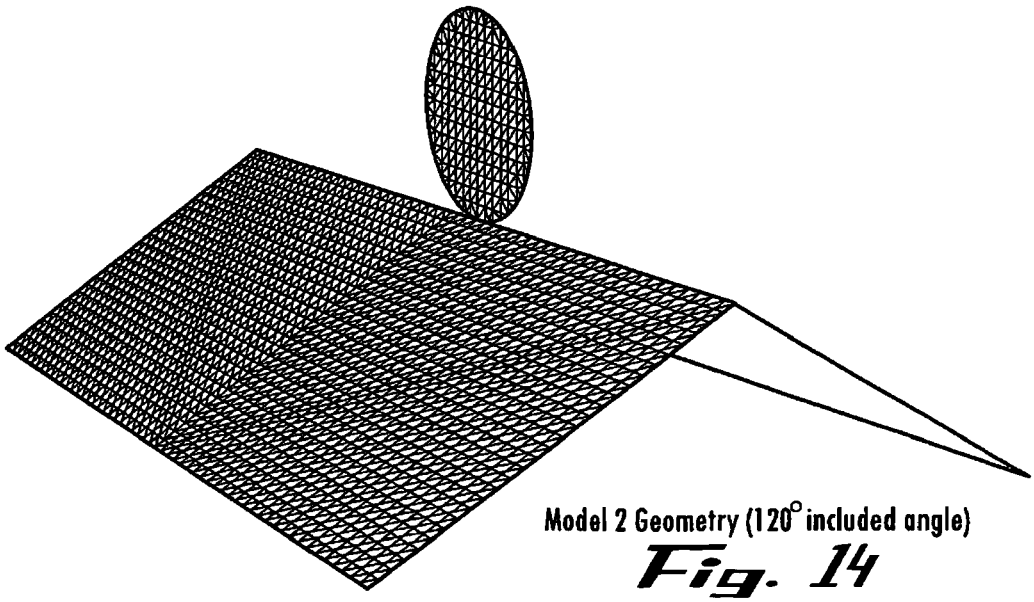
FIG. 14 is a perspective view of an analytical model 2 of the antenna of FIG. 1, with an angled ground plate.
Figure 19:
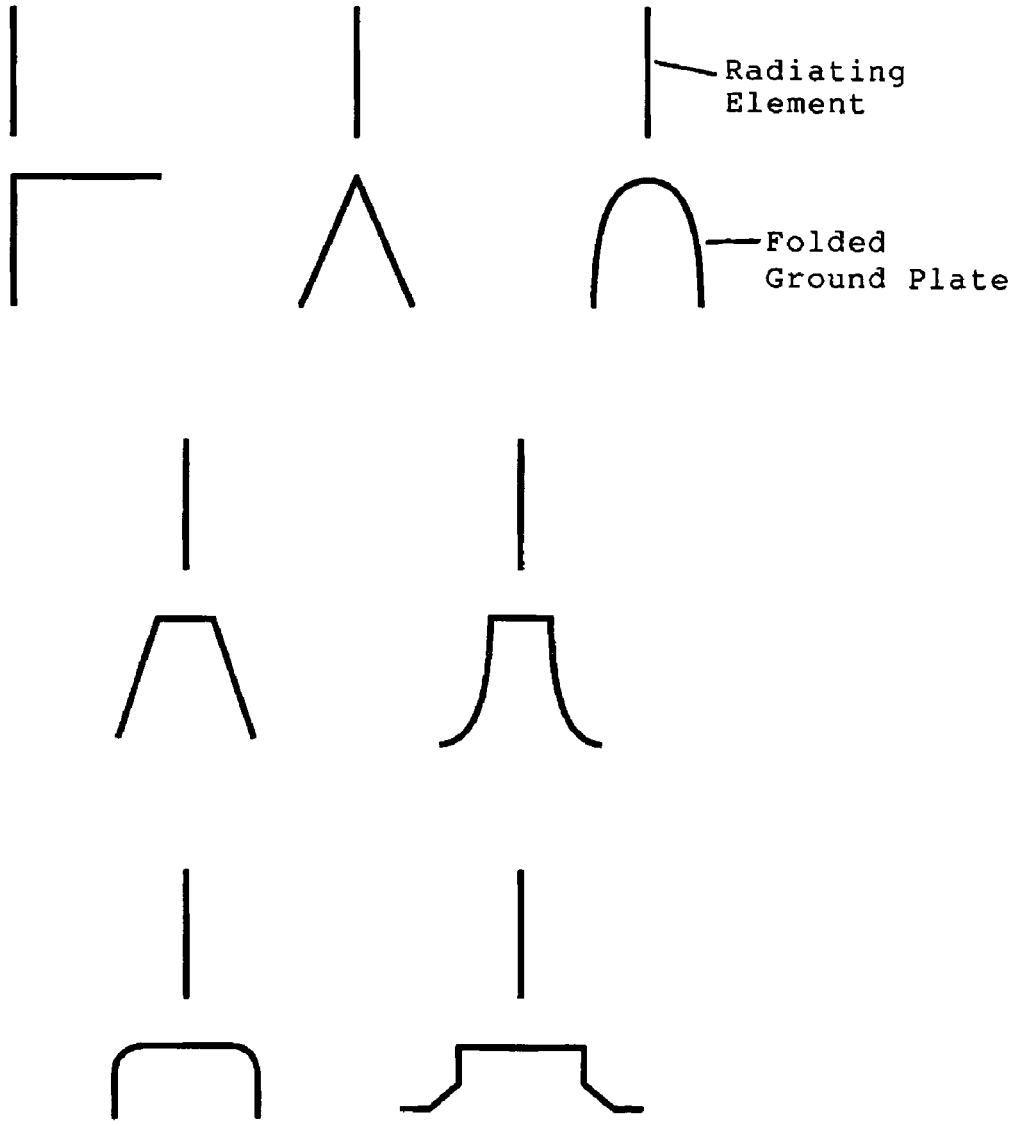
FIG. 19 is a schematic illustration of some folded and shaped ground plate configurations that can be incorporated in the present invention.

To help maintain the vertical orientation of the antenna element 11 perpendicular to the ground plate 16, a cross brace 21 is received in a slot 34 formed in an upper portion of the antenna element. The ground plate is flat, horizontal and square in this embodiment but may be folded or curved in other embodiments, as shown in FIGS. 14 and 19. The cross brace 21 has feet 22, 23 for engaging (e.g., pressing against) the upper surface of the aluminum ground plate 16. In this way, the cross brace helps to stabilize the antenna element 11 perpendicular the ground plate 16. The cross brace 21 includes snap-fit features that engage complementary features in the antenna element to retain the cross brace within the slot 34. The ground plate 16 also has a slot that closely matches the horizontal cross-sectional profile of the antenna element 11 so that the antenna element is closely received in the slot. Likewise, the trim piece 12 has a slot 26 for receiving antenna element 11. The length of the slot 26 is designed to be slightly narrower than the antenna element 11, which creates a pressure fit that combines with the ratchet teeth 27, 28 to grip the trim piece 12 as it is pushed onto the antenna element 11. To provide flexibility of these ratchet teeth, the areas immediately adjacent the ratchet teeth include relief openings 31, 32 to allow the teeth to be squeezed slightly toward each other as the trim piece 12 is inserted over the antenna element 11. An electrical cable 33, such as a coaxial cable, is connected to the antenna element 11 on one end and to a remote electronic device on the other end. The cable 33 carries transmit and receive communication signals between the remote device and the antenna 10, which typically operates in a duplex communication mode.

Figure 5:
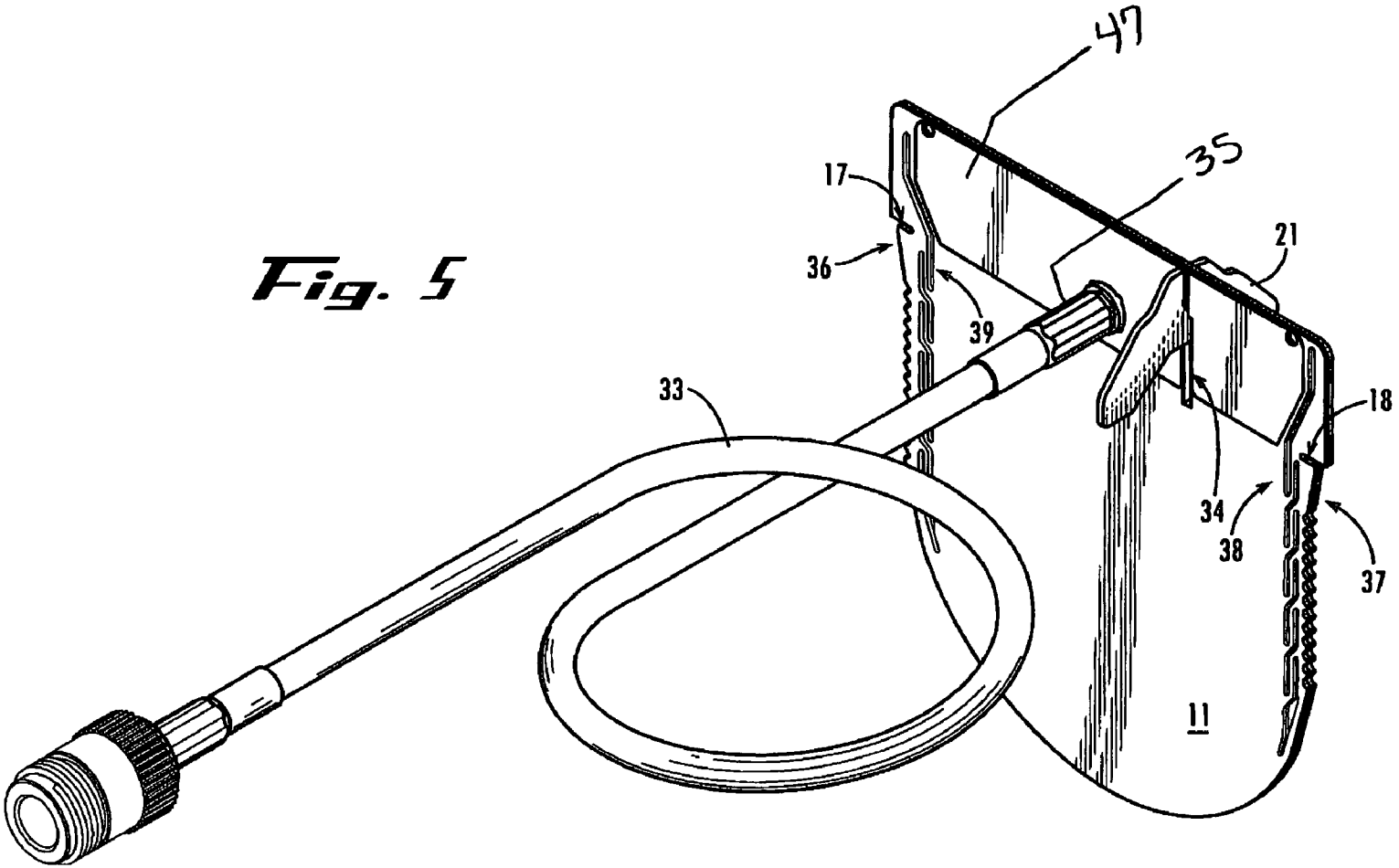
FIG. 5 is a perspective, detailed view of the antenna of FIG. 1 shown apart from the ceiling and with a cable attached thereto.

FIG. 5 shows the antenna element 11 separate from the ground plate. As seen in this figure, the cross brace 21 is received in a slot 34. Also, the shoulders 17 and 18 extend laterally and are immediately adjacent ramp surfaces 36 and 37. As best seen in this figure and in FIG. 3, strain relief slots 38, 39 extend from adjacent the ramped surfaces 36 and 37 upwardly toward the top end of the antenna element 11. Each of these strain relief slots is long, rather narrow, and slightly offset. These strain relief slots allow some "give" to the ramp surfaces 36 and 37 such that as the antenna element 11 is pushed into the slot in the ground plate 16, the ground plate squeezes on these ramp surfaces to grippingly engage the antenna element 11, while the shoulders 17 and 18 prevent insertion beyond a maximum amount. FIG. 5 also shows that the antenna element 11 carries a coaxial cable connector 35 that receives the coaxial cable 33. The outer grounding sheath of the coaxial cable 33 electrically connects to the secondary ground plate 47 when the cable 33 is connected to the cable connector 35.

The antenna element 11 is a laminated structure. In particular, the panel 11 includes printed transmission signal paths sandwiched between dielectric boards, best seen in FIGS. 6A through 6D and FIG. 7. Referring first to FIG. 7, a metal radiating disk 41 is bonded to a printed circuit board dielectric layer 42. The antenna element or disk 41 is protected by a second printed dielectric layer 43 which is to the first dielectric layer 42 with adhesive layer 44. In one form, the adhesive layer 44 comprises a thin, two-faced adhesive tape. This construction effectively encapsulates the radiating disk 41, obviating the need for a separate radome. A small, secondary ground plate 47 is bonded to the upper end of the backside of the first print circuit board material layer of 42, as noted above. FIGS. 6A-D also show the slots 38, 39 through the antenna element 11 as well as the ratchet teeth 27, 28 and the associated strain relief openings 31, 32.

The adhesive layer 44 can be acrylic pressure-sensitive transfer adhesive such as one type manufactured under the trade name VHB™ by 3M Corporation located in St. Paul, Minn. with thickness values on the order of two thousandths (0.002) to five thousandths (0.005) of an inch. Other acrylic adhesive systems also can be used including wet application systems. The present invention is not limited to the use of acrylic adhesive systems although acrylic adhesive systems are preferred. The use of a pressure sensitive adhesive (PSA) is preferred for the adhesive layer 44 to ease assembly without the need of bonding systems requiring both heat and pressure such as conventional bonding films used in printed circuit board processing.

Figure 6B:
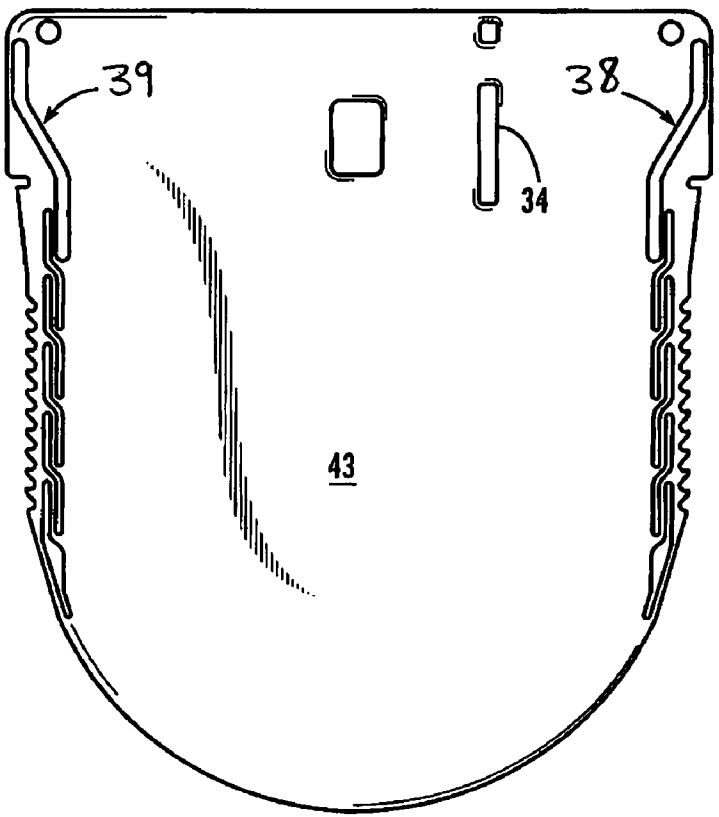
FIG. 6B is a back view of the portion of the antenna of FIG. 6A.
Figure 6A:
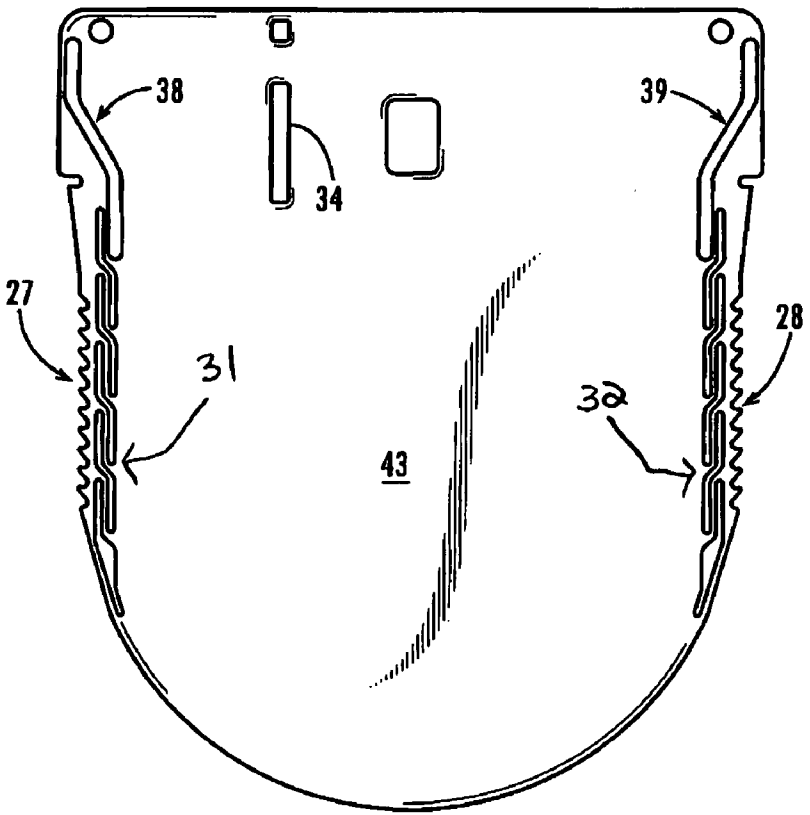
FIG. 6A is a front view of a portion of the antenna of FIG. 1.

FIGS. 6A and 6B show the front and back of one of the print circuit board material layers, in particular layer 43. FIG. 6A shows the front of this layer, while FIG. 6B shows the back. It should be noted that these figures (and FIGS. 6C and 6D as well) show these layers after final machining, which occurs after the sheets have been laminated together, rather than showing what they look like prior to being adhered together and then machined. In other words, prior to adhering the two print circuit board layers together, there are fewer features than what are shown in these figures. After the layers are laminated together, final machining can be performed to produce various features of the device, such as the ratchet teeth and the strain relief slots. The machining operation is conventionally known as "routing" in the printed circuit board industry and the operations performed to create the routed features can be carried out with conventional equipment used to process rigid printed circuit boards.

Figure 6D:
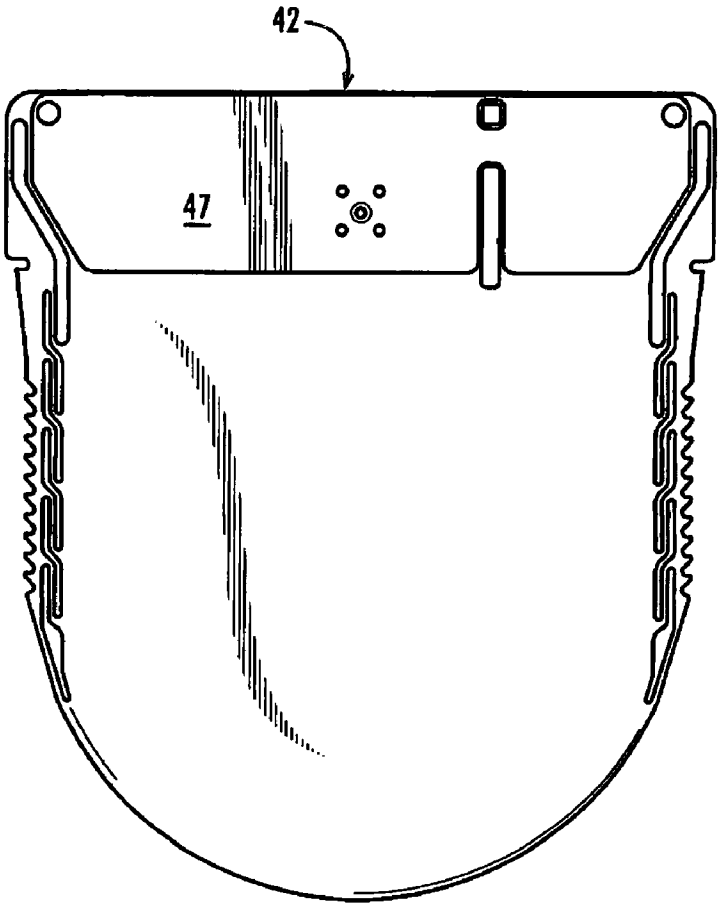
FIG. 6D is a front view of the second portion of the antenna of FIG. 6C.
Figure 6C:
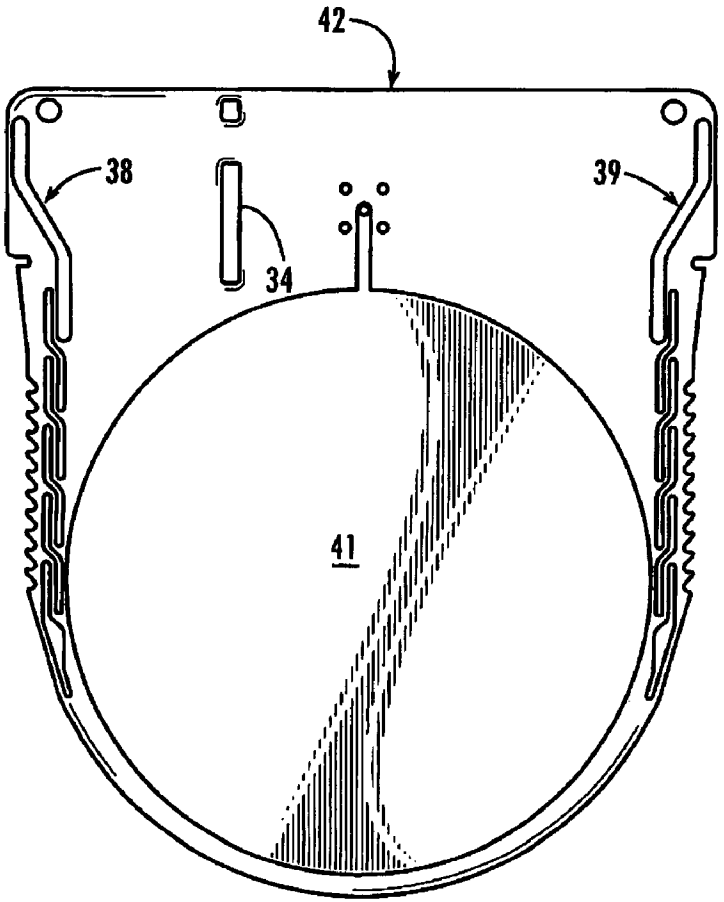
FIG. 6C is a back view of a second portion of the antenna of FIG. 1.
Figure 7:
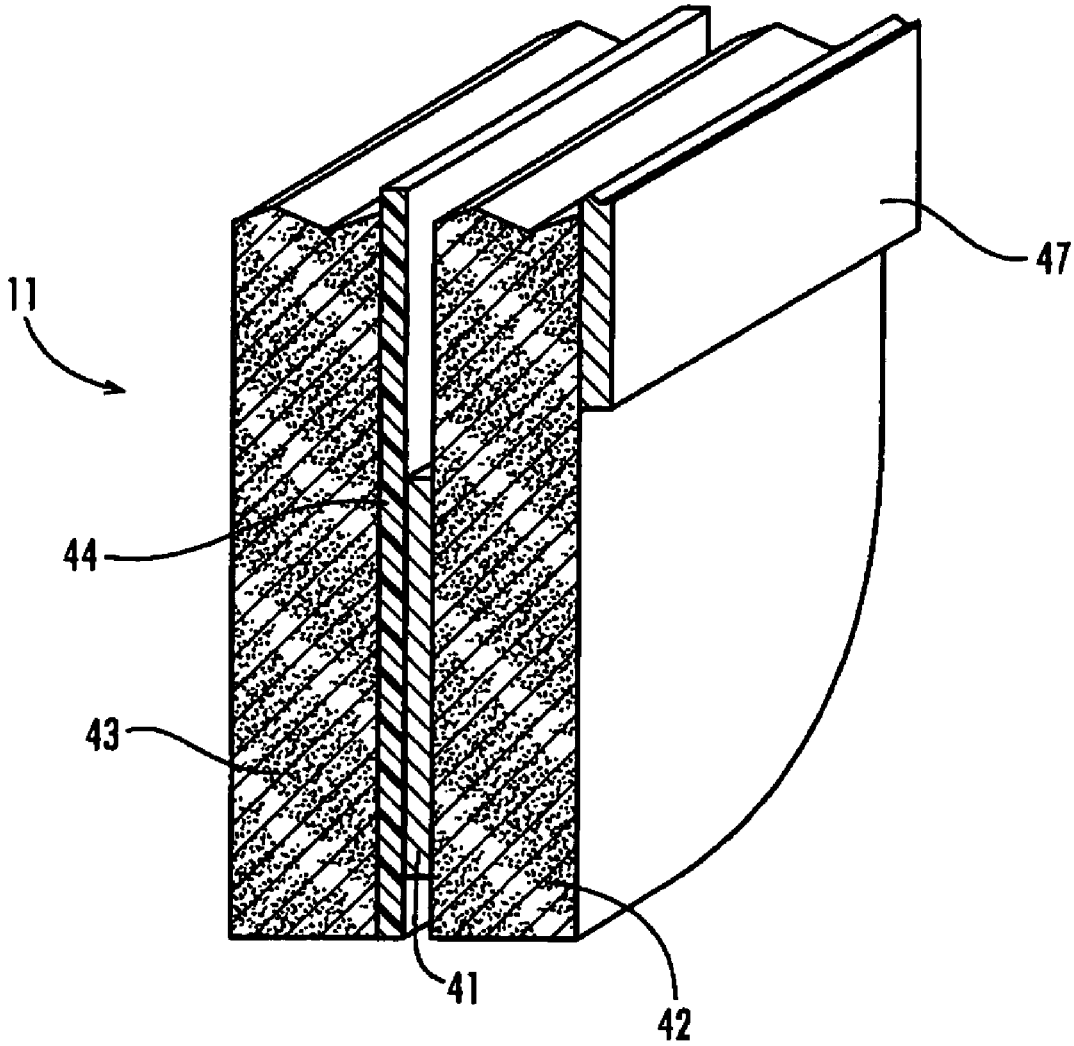
FIG. 7 is a sectional view of a portion of the antenna of FIG. 1.

FIGS. 6C and 6D show the front and back of one of the printed circuit board material layers, in particular layer 42. As seen in these figures, layer 42 bears on one side a disk-shaped monopole antenna element 41 in the form of a thin layer of metal, such as copper. The thin copper layer can be a 1 oz. thickness corresponding to approximately 0.0014 inch thickness. While a perfectly circular shaped monopole antenna element 41 is shown, other shapes could be employed. These figures also show the relative positions of the monopole antenna element 41 and the secondary ground plate 47.

Figure 8:
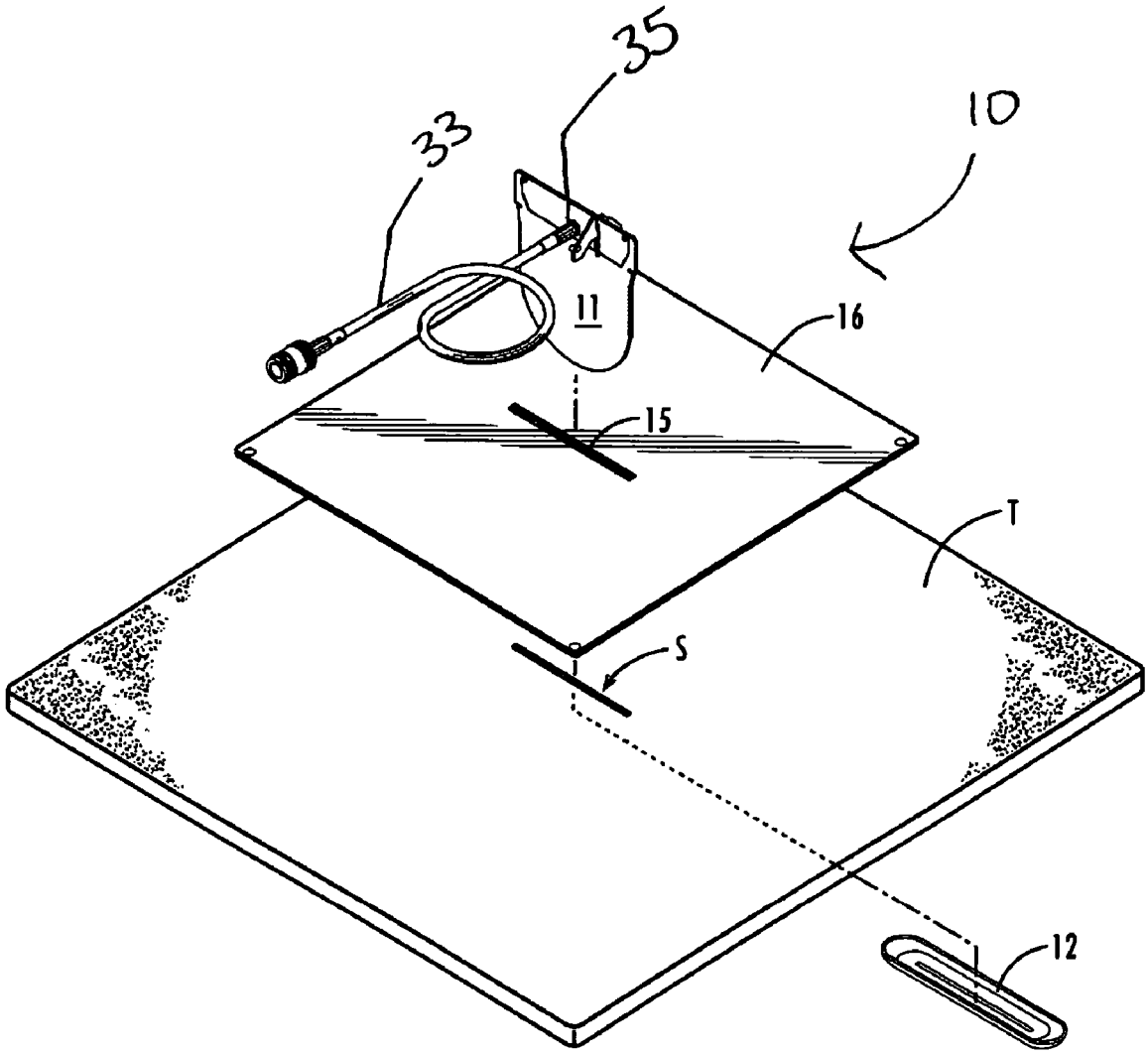
FIG. 8 is an isometric, partly exploded view of the antenna of FIG. 1.

FIG. 8 depicts the installation of the antenna 10 in a ceiling. First, a slot S is cut in a ceiling tile or ceiling T. Next, the ground plate 16 is positioned over the ceiling tile T and the slot 15 formed in the ground plate 16 is positioned over the slot S in the ceiling tile T. The antenna element 11 is then inserted through the slot 15 and through the slot S to extend the antenna element through the ground plate and through the ceiling tile such that a substantial portion of the antenna element protrudes below the bottom of the ceiling tile. The trim piece 12 is then pushed upwardly onto the antenna element 11 and is secured by the ratchet teeth. The coaxial cable 33 is also connected on one end to the coaxial cable connecter 35 on the antenna element and on the other end to a remote device for communication with the antenna 10. This configuration allows the antenna to be installed in a ceiling using a minimum of tools, preferably only a standard utility knife or other suitable tool for cutting the slot S in the ceiling.

Once installed in this manner, the antenna 10 provides acceptable communication within generally accepted industry standards for duplex communications within a frequency band having at least an approximate 2:1 ratio from the highest frequency value to the lowest frequency value in the carrier frequency band. An antenna according to the present invention is extremely advantageous from both structural and operational standpoints. Generally, the antenna provides an extremely wide operational frequency range. Such an antenna can provide coverage from as low as a few hundred Megahertz (MHz) to several Gigahertz (GHz). In particular, it is contemplated that antennas of this basic design can be configured to provide coverage from about 400 MHz to about 6 GHz (more than 1000% bandwidth).

In a commercial embodiment of the present invention, for example, the antenna is configured for duplex communications in the carrier frequency ranges from approximately 800 MHz through 2400 MHz, which covers the analog cellular, PCS, GSM and WiFi carrier frequencies. This allows the same antenna design to operate for a wide variety of devices operating within these frequency bands, such as wireless telephones, wireless computer networks, wireless Internet nodes, PDA devices, and the like. In this regard, the antenna should be considered largely "carrier neutral" and "application neutral." The present antenna is also aesthetically pleasing and unobtrusive, obviating the need for a separate protective radome. It also is extremely easy to install in existing ceilings or ceiling tiles in existing and newly constructed facilities.

Figure 11:
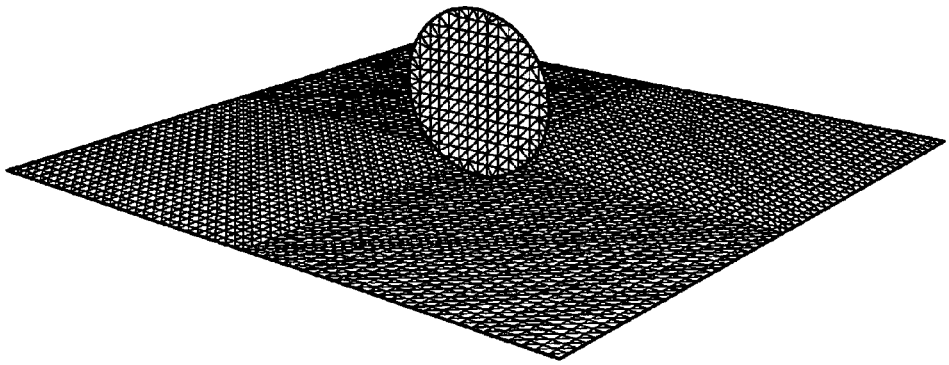
FIG. 11 is a perspective view of an analytical model 1 of the antenna of FIG. 1 with a flat ground plate.
Figure 12:
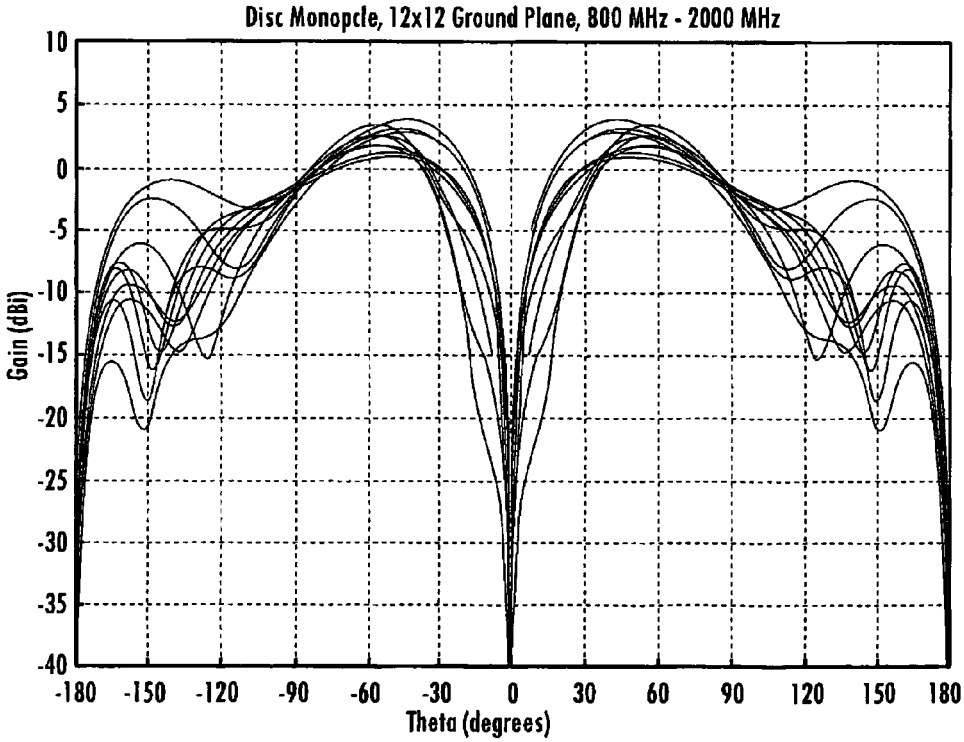
FIG. 12 is a graph of analytical radiation pattern characteristics of the antenna of FIG. 11 with the pattern cut in the plane of the radiator.
Figure 13:
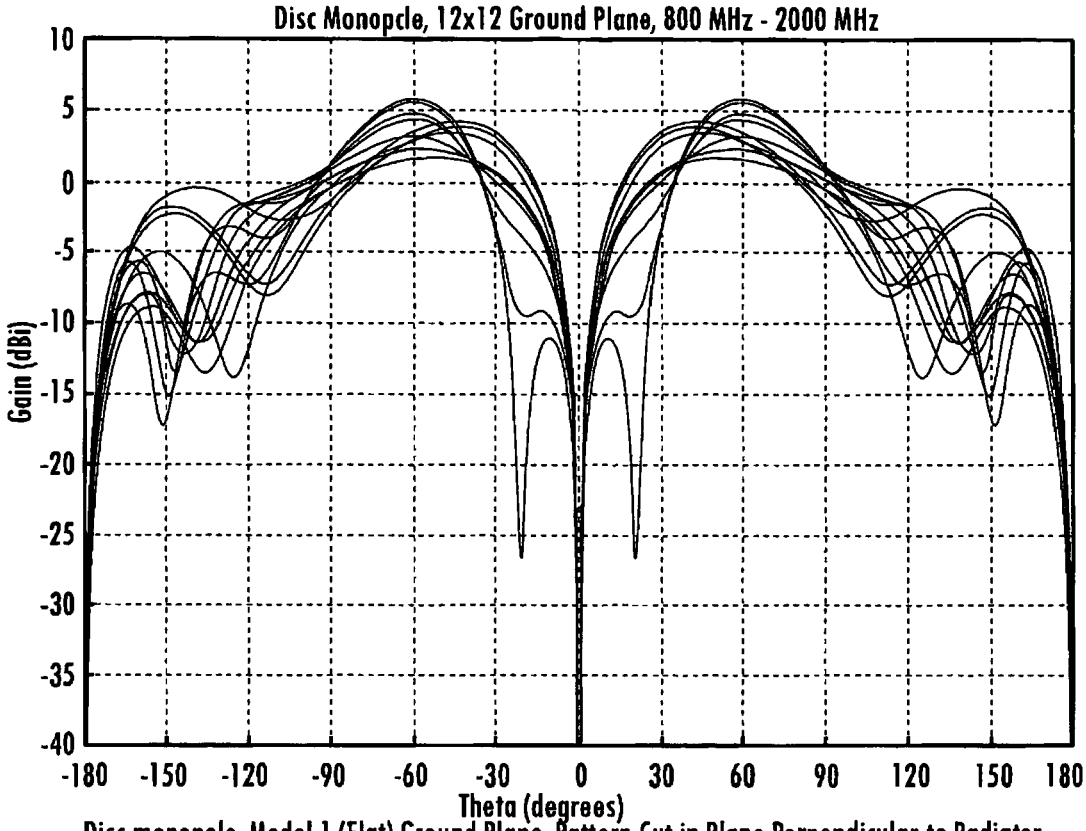
FIG. 13 is another graph of analytical radiation pattern characteristics of the antenna of FIG. 11 with the pattern cut in a plane perpendicular to the radiator.

In the commercial embodiment the monopole element is 3 inches (7.62 cm) in diameter and the circular monopole conductor disk radiating element inserted through a 12 inches (30.48 cm) by 12 inches (30.48 cm) conducting ground plate. The geometry and principal plane patterns simulated over the 800-2000 MHz band are shown in FIGS. 11 through 13. The coverage patterns in the principal planes are sampled at 11 frequency values across the 1200 MHz bandwidth from 800-2000 MHz. The coverage pattern approaching plus or minus 90° is seen to generally drop below 0 dBi gain as the coverage pattern approaches plus or minus 90°, and the gain is −2 to −3 dBi in the plus and minus 90° directions. The principal planes are at the planes parallel and perpendicular to the plane of the antenna element.

Figure 9:
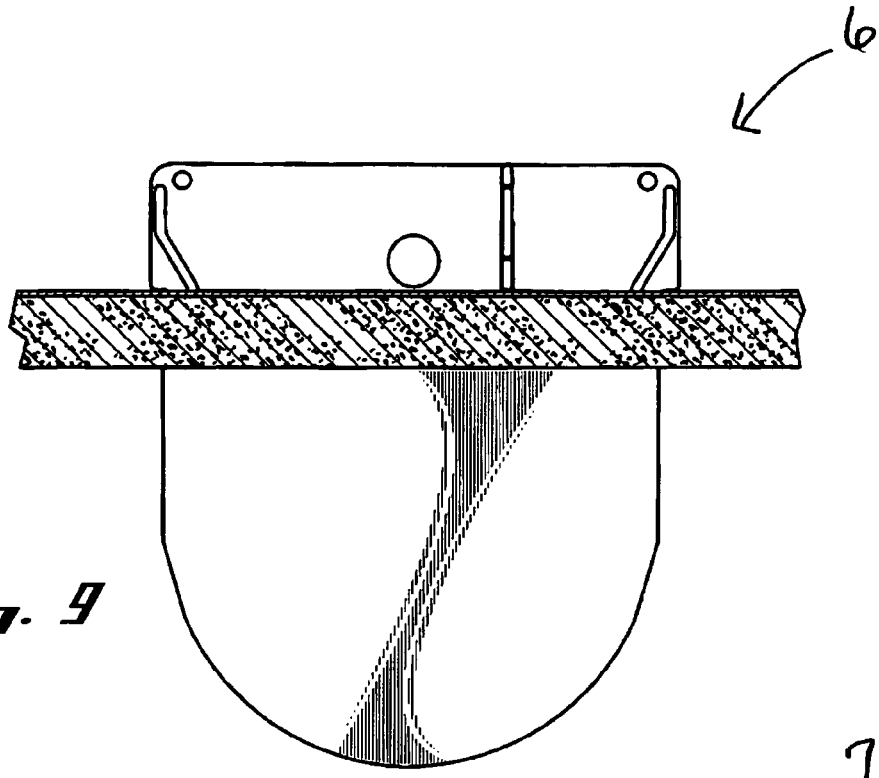
FIG. 9 is a front view of the antenna according to a second preferred form and shown mounted to a ceiling.
Figure 10:
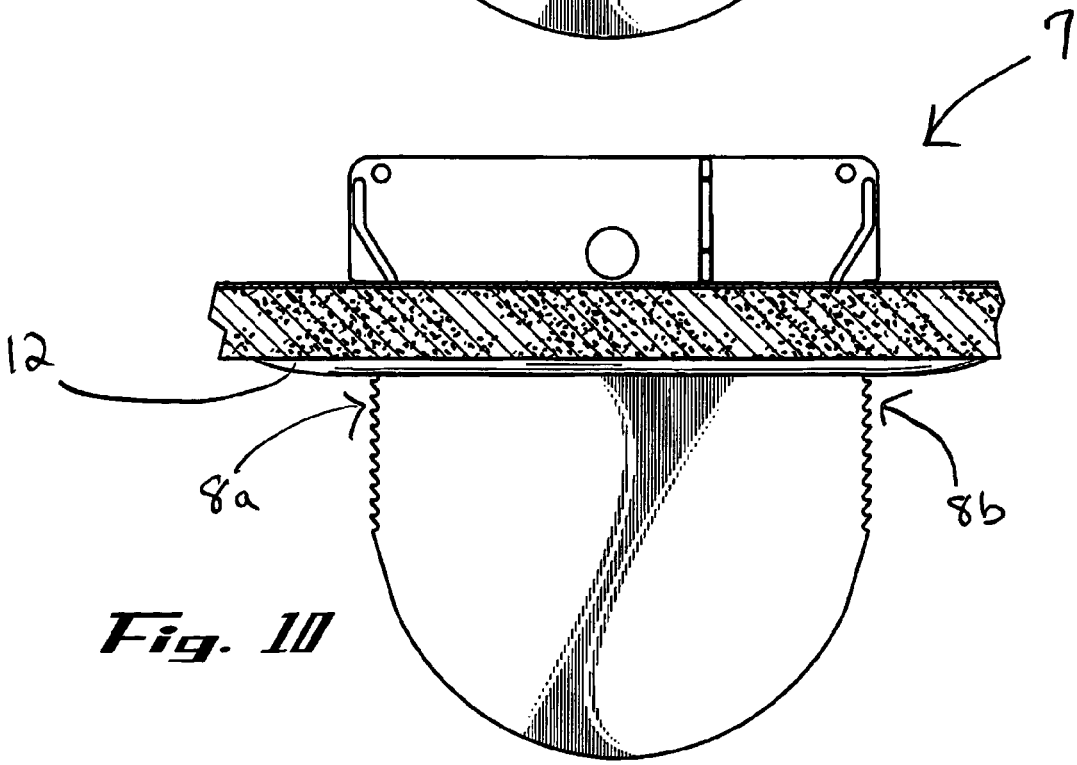
FIG. 10 is a front view of the antenna according to a third preferred form and shown mounted to a ceiling.

FIG. 9 and FIG. 10 show alternative constructions 6 and 7 for the antenna. As shown in FIG. 9, the trim piece could be done away with, which obviates the need for the ratchet teeth and related features in antenna 6. Also, as for antenna 7 in FIG. 10, the ratchet teeth 8*a-b* are provided for engaging the trim piece without strain relief slots.

Figure 15:
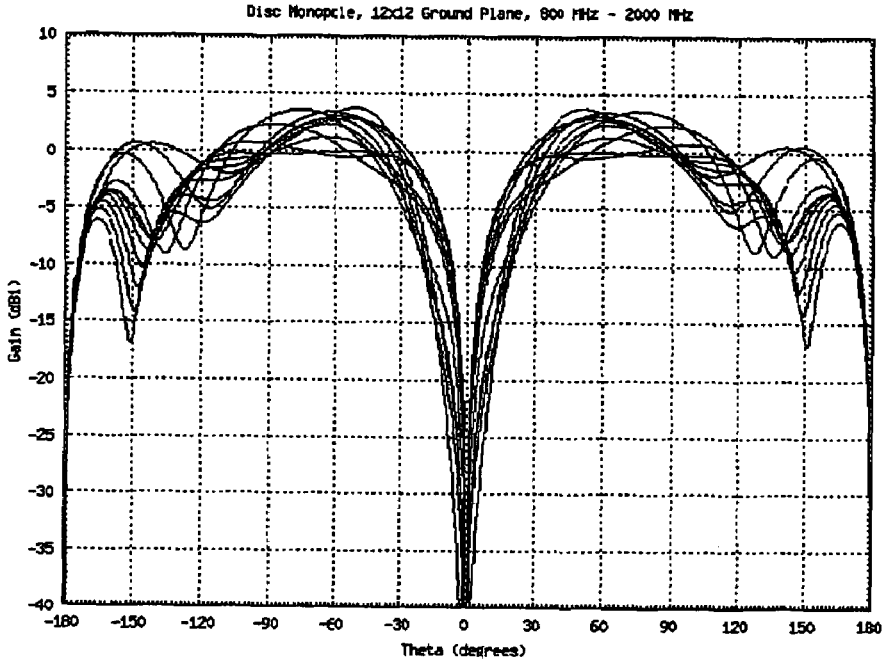
FIG. 15 is a graph of analytical radiation pattern characteristics of the antenna of FIG. 14 with the pattern cut in the plane of the radiator.
Figure 16:
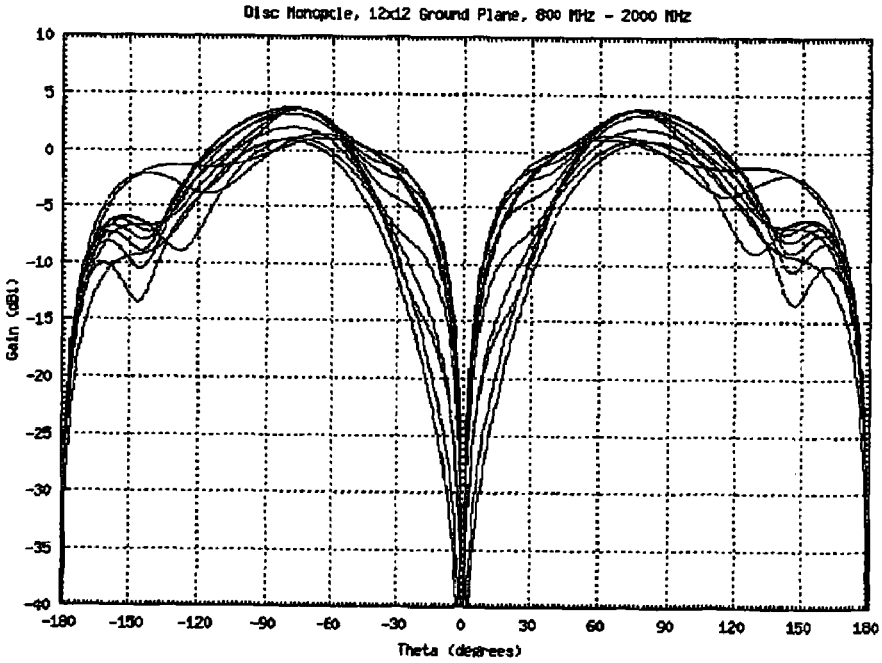
FIG. 16 is another graph of analytical radiation pattern characteristics of the antenna of FIG. 14 with the pattern cut in a plane perpendicular to the radiator.

FIG. 14 shows an alternative geometry in which the ground plate has been folded about a line rotated 30° relative to the plane of the antenna element. The simulated patterns for the same principal planes are shown in FIGS. 15 and 16, where it can be observed that the gain coverage is enhanced in a range of 60° to 90° from a bore site null in the direction of the intersection between the principal planes. This result suggests that the ground surface can be shaped advantageously over a relatively broad range of frequencies to improve the far coverage that is generally the problem to be solved for indoor communication coverage. In fact, the far coverage shown is, at some frequency values, as good as or better than the coverage for the relatively narrow band planar sleeve dipole known in the prior art.

Figure 17:
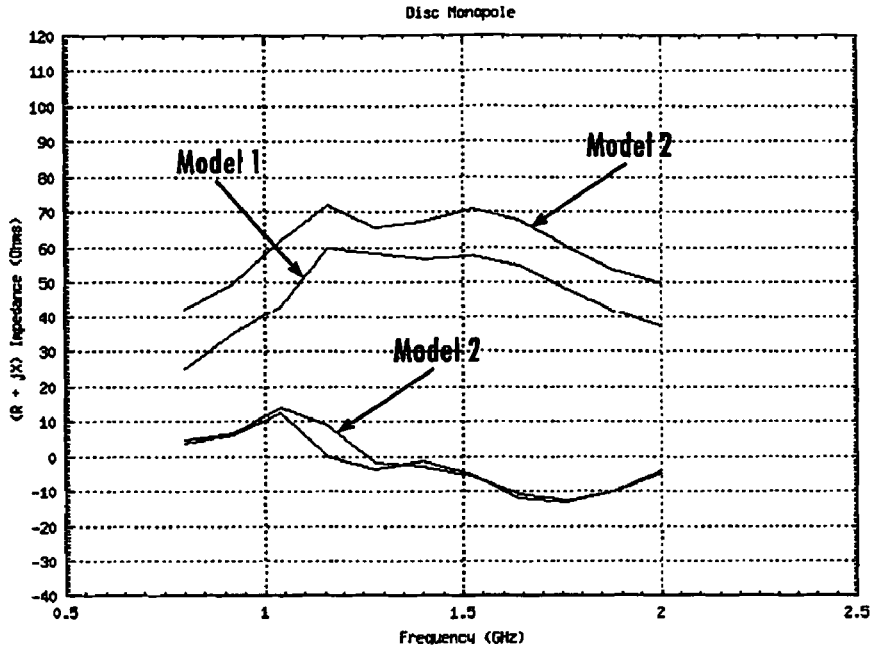
FIG. 17 is a graph comparison of analytical results for the complex impedance over a range of frequency values of the antenna models 1 and 2 of FIGS. 11 and 14, respectively.
Figure 18:
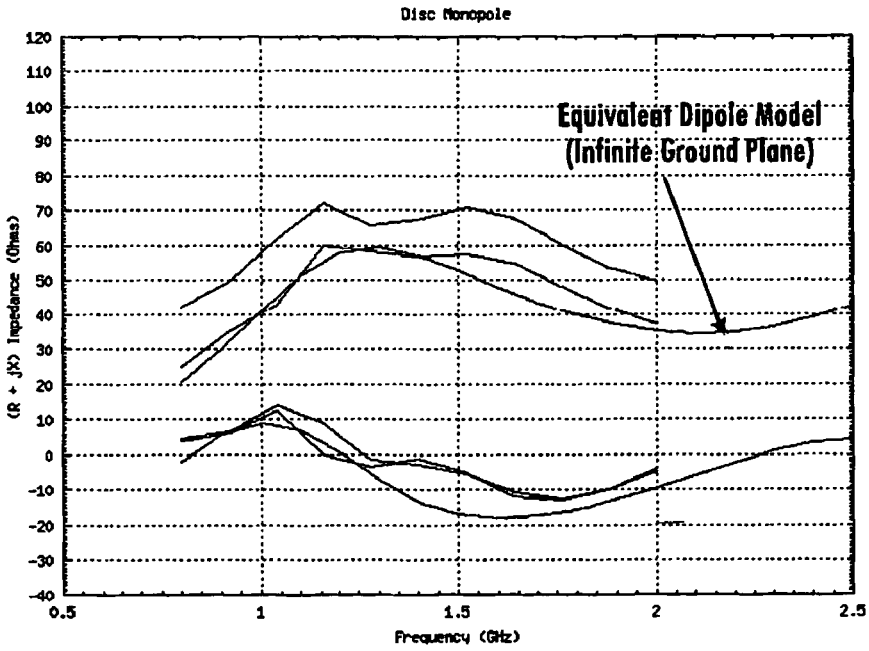
FIG. 18 is the graph of FIG. 17 with the addition of analytical results for the complex impedance of an equivalent disc dipole model that also represents the circular monopole over an infinite flat ground plate.

The simulated impedance of the disk monopole for both cases is shown in FIGS. 17 and 18 for the finite ground plate and is contrasted with the equivalent dipole impedance (monopole over infinite ground plate) previously simulated for the 3 inch (7.62 cm) diameter circular disk. The geometry in Model 2 does not adversely affect the impedance match relative to 50 Ω in the bands of interest (800-960 MHz, 1700-2000 MHz) and in fact can offer an improved impedance match.

The initial results suggest further improvements may be available by other configurations of the ground surface shape and size in one or more planes relative to the antenna element. Since the ground surface is generally located above a suspended ceiling tile, any shaping of the ground surface is not considered to be adverse to the appearance of the antenna since the ground surface cannot be seen after installation.

FIG. 19 shows a variety of folded ground plate configurations. The folded ground plate configurations generally provide improved far reception by increasing the antenna gain near plus and minus 90° from vertically down. This improved far reception is shown in the comparison between FIGS. 12-13 for the flat ground plate configuration shown FIG. 11 as compared to FIGS. 15-16 for the folded ground plate configuration shown in FIG. 14. Included in this figure are depictions of additional examples of folded and curved ground plates including (starting at the top left): right angle; acute angle; convex curved; tri-fold; curved tri-fold; multi-faceted; and stepped (with beveled corners). Other configurations of the folded ground plate are also possible.

Figure 20A:
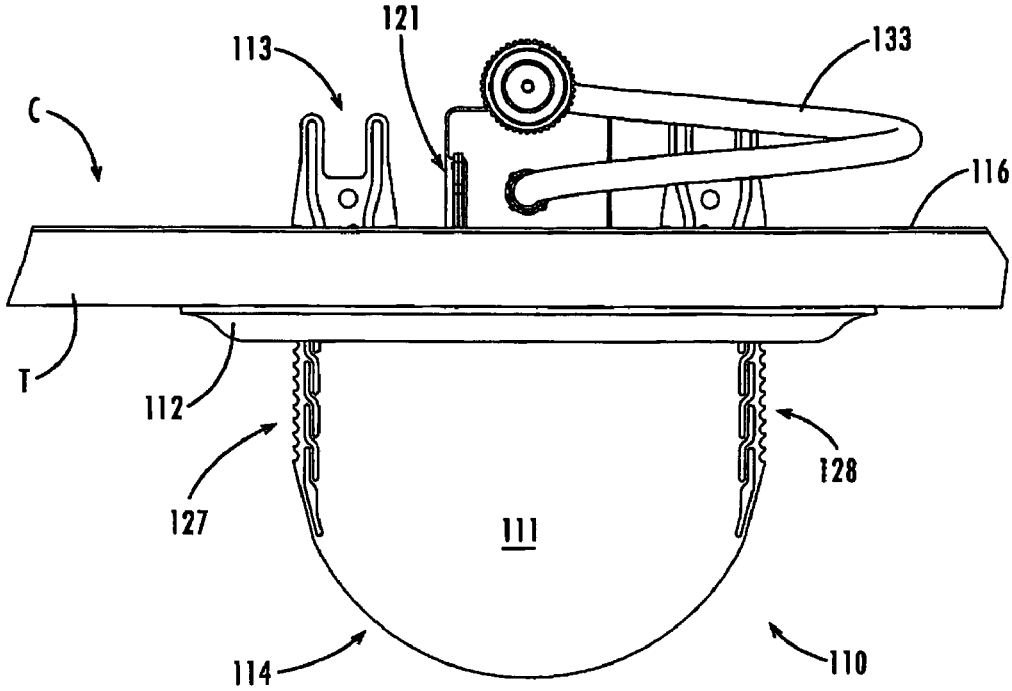
FIGS. 20A and 20B are, respectively, a rear view and a side view of the antenna according to a fourth preferred form and shown mounted to a ceiling.
Figure 20B:
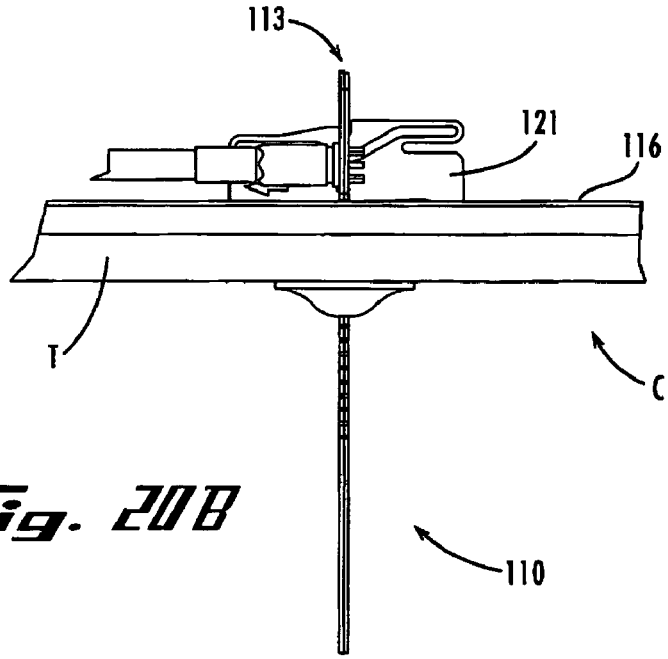
Figure 24A:
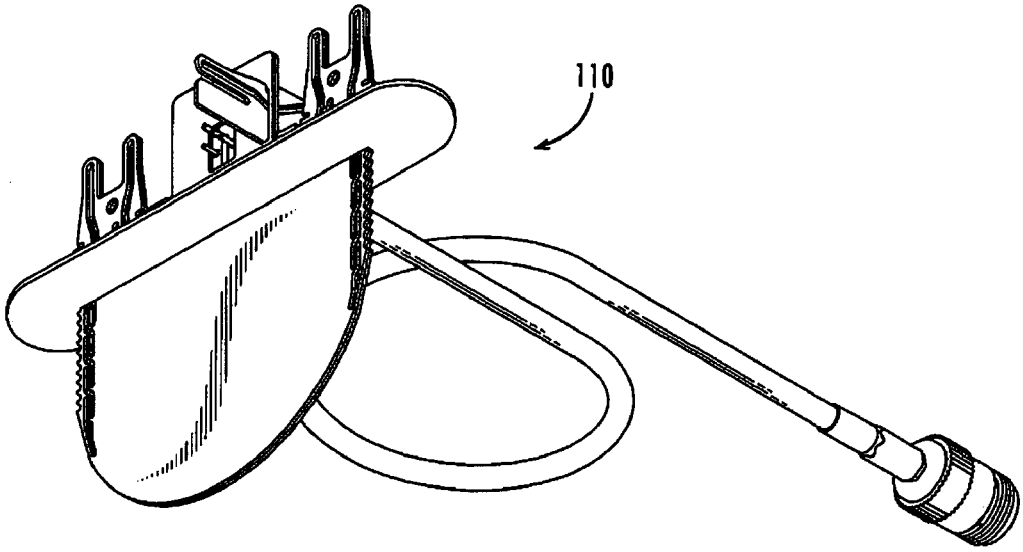
FIGS. 24A and 24B are, respectively, a front perspective view and a rear perspective view of the antenna of FIGS. 20A, 20B.
Figure 24B:
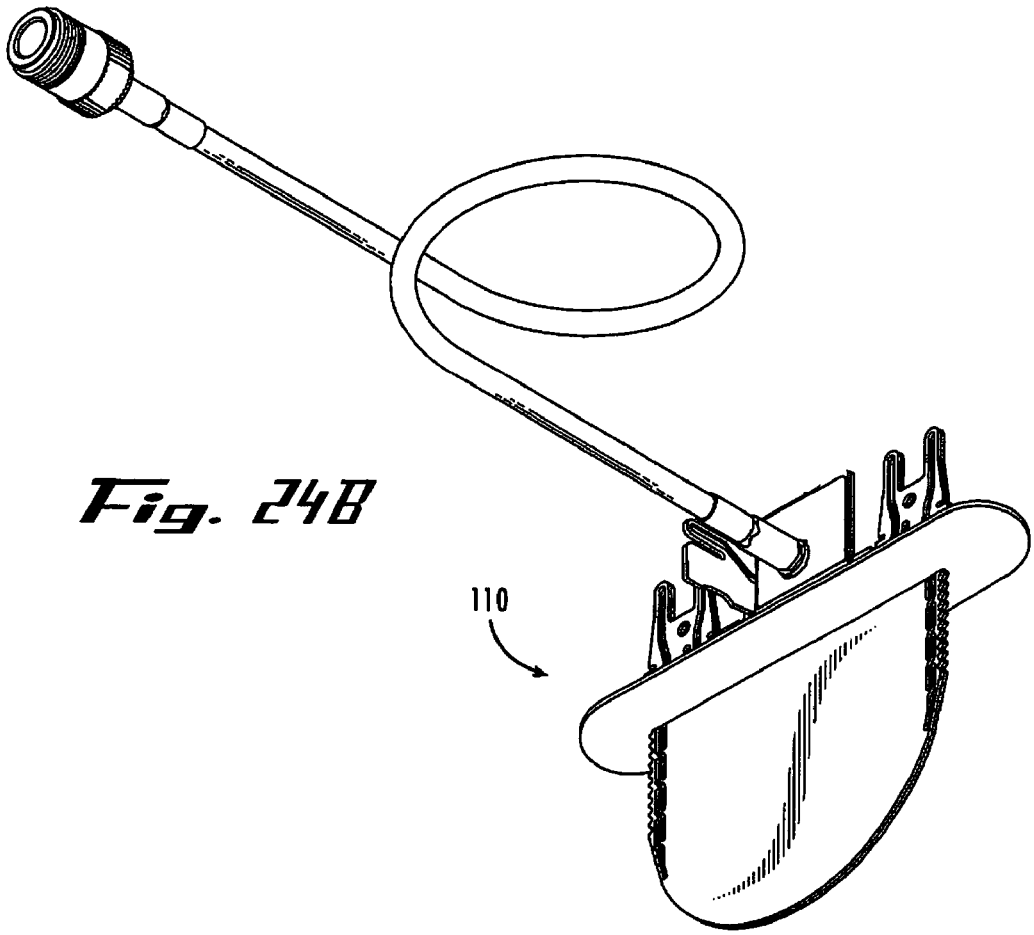

Referring now to FIGS. 20A and 24B, another embodiment of the invention is shown, including an antenna 110. The antenna 110 is shown mounted to a ceiling C, comprised of modular ceiling tiles T. As shown in FIGS. 20A, 20B, the antenna 110 is relatively small in relation to the conventional ceiling tile T. The antenna 110 includes an antenna element 111 which protrudes downwardly from the ceiling tile and has a generally fin-like appearance. A trim piece 112 surrounds the antenna element 111 adjacent the ceiling tile to conceal the opening formed in the ceiling tile for receiving the antenna element 111 extending through the trim piece.

The upper end 113 of the antenna element 111 is generally square, while the bottom end 114 of the antenna element 111 is smoothly rounded. Antenna element 111 extends through an aluminum ground plate 116 and through the ceiling tile T. The antenna element 111 also extends through the trim piece 112. The aluminum ground plate 116 can be of various sizes and thicknesses. Antenna element 111 extends partly through the ground plate 116 and is supported by the ground plate 116 by shoulders formed in the antenna element itself. The shoulders are sufficient to support the antenna element vertically. To help maintain the perpendicular, vertical orientation, a cross brace 121 is provided. The cross brace 121 is received in a slot formed in an upper portion of the antenna element. In this way, the cross brace helps to stabilize the vertical orientation of the antenna element 111.

Figure 21:
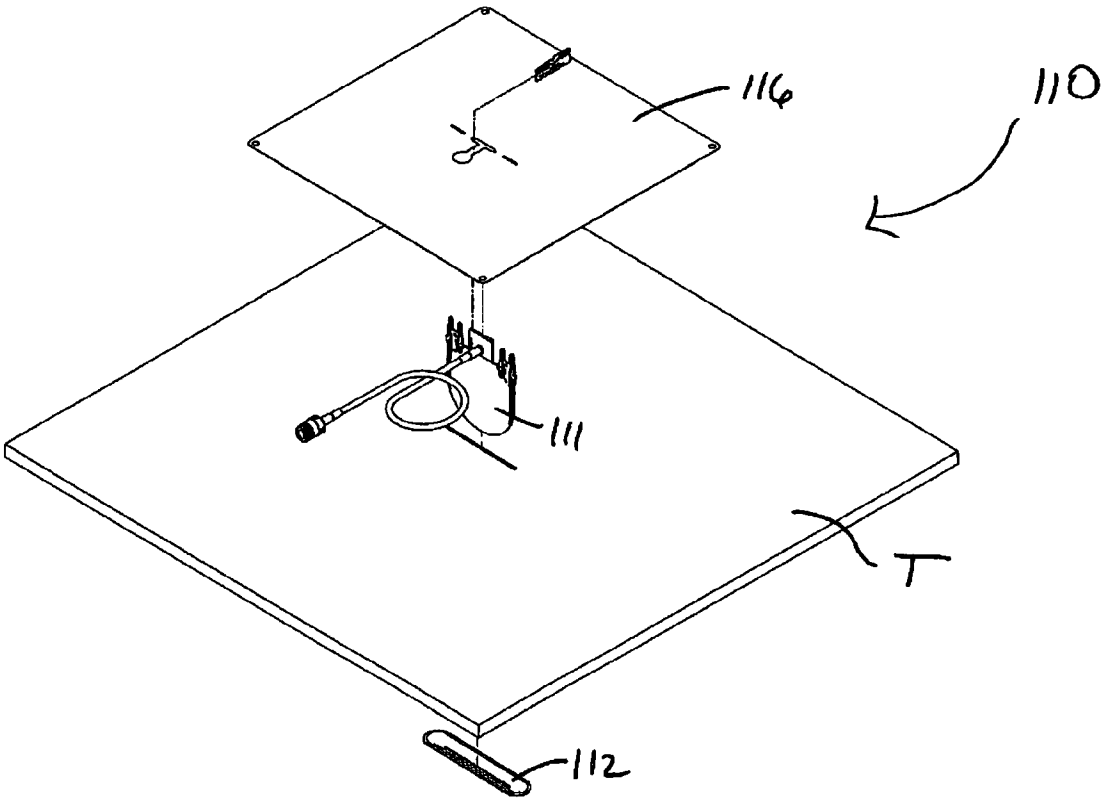
FIG. 21 is a partly exploded isometric view of the antenna of FIGS. 20A and 20B shown mounted to a ceiling.
Figure 22B:
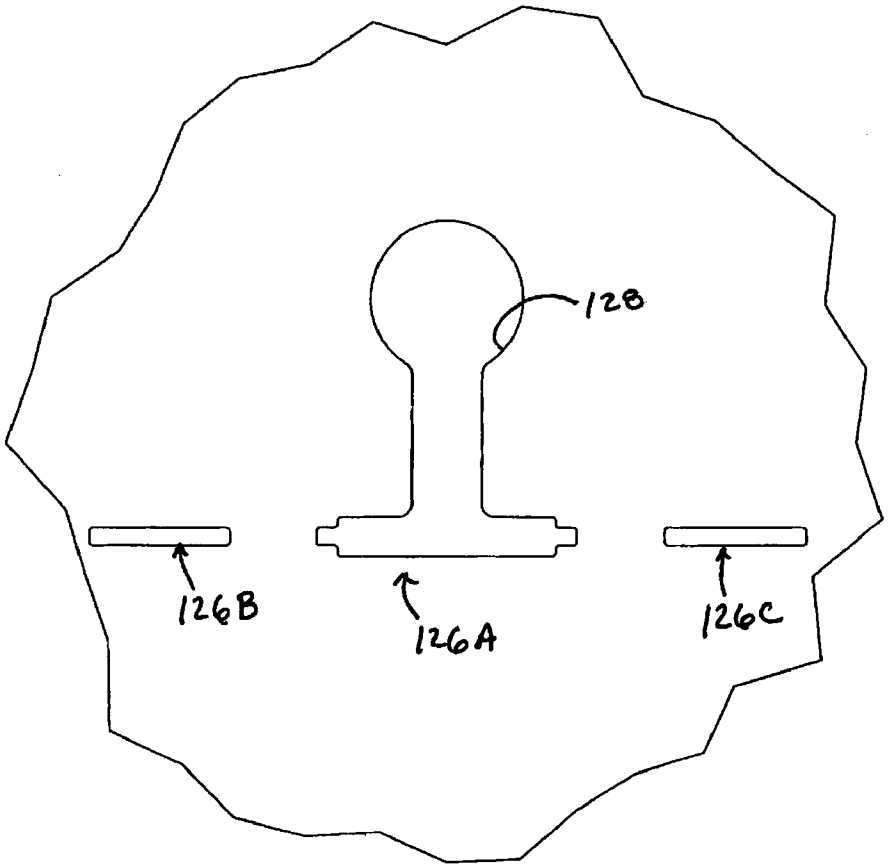
FIG. 22B is a detailed plan view of the antenna portion of FIG. 22A.
Figure 22A:
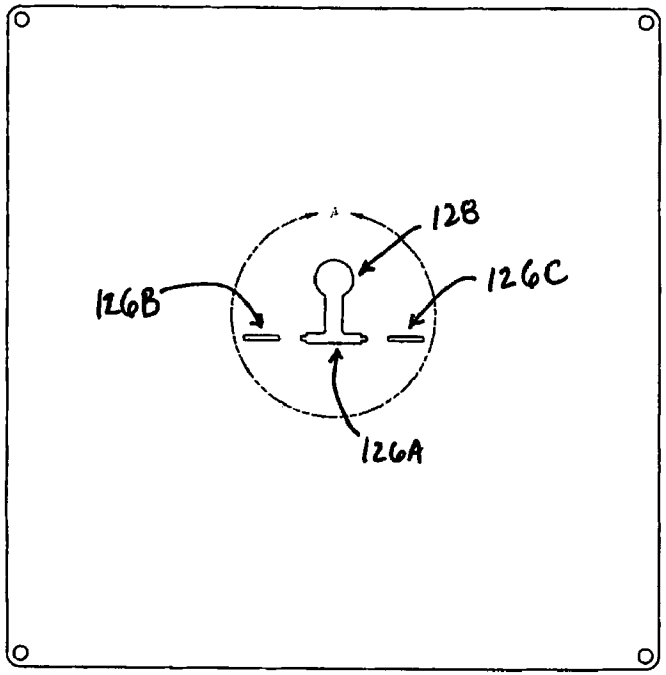
FIG. 22A is a detailed plan view of a portion of a ground plate of the antenna of FIGS. 20A and 20B.

The ground plate 116 has some slots or slots formed in it which collectively are closely matched to the profile of the antenna element 111 such that the antenna element is closely received in the slots or slots. This is best seen in FIGS. 21 and 22B, in which the ground plate can be seen to include an inboard slot 126A and a pair of outboard slots 126B, 126C. These slots cooperate with finger-like portions of the upper portion of the antenna element 111 to receive the antenna element through the slots. A keyhole-shaped opening 128 is formed in the ground plate 116 to help accommodate threading a cable, such as cable 133, onto the antenna. Also, the trim piece 112 has a slot for receiving antenna element 111. The length of the slot in the trim piece is designed to be slightly less than the overall width of the antenna element 111. This creates a pressure fit that combines with ratchet teeth 127, 128 to grippingly engage the trim piece 112 as it is pushed onto the antenna element 111. An electrical cable 133, typically a coaxial cable, provides a signal to be transmitted and received from the antenna (i.e., duplex communication).

FIG. 21 shows the antenna element 111 separate from the ground plate. As seen in this figure, the antenna element is inserted upwardly (from below) into the ground plate 116 until the fingers lock in place in the slots 126A-C. The cross-piece 121 is then inserted through the antenna element 111 to further lock the antenna element to the ground plate. Then the antenna element 111 can be lowered into and partially through the tile T and into and partially through the trim piece 112.

Figure 23C:
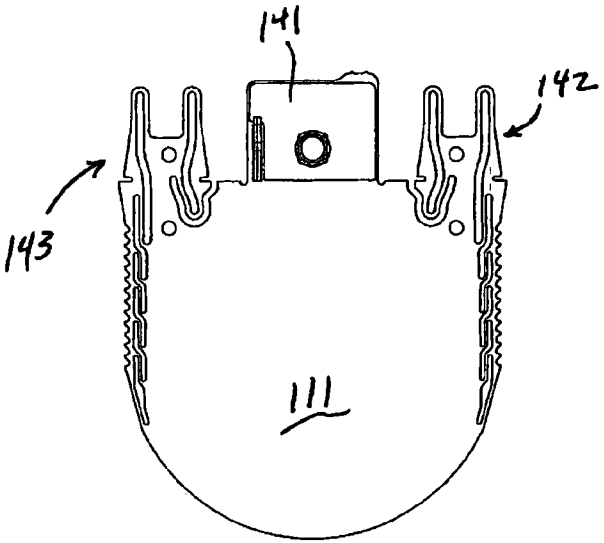
FIGS. 23A-C are, respectively, a front view, a side view, and a rear view of the antenna of FIGS. 20A, 20B.
Figure 23B:
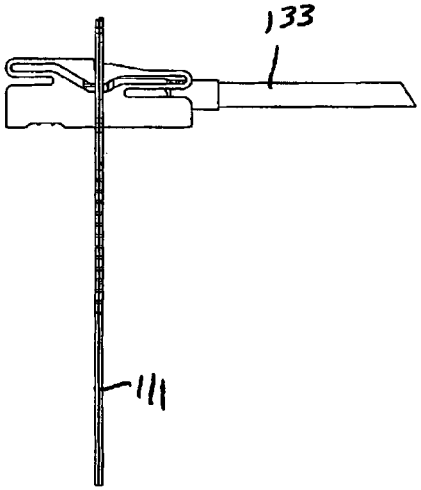
Figure 23A:
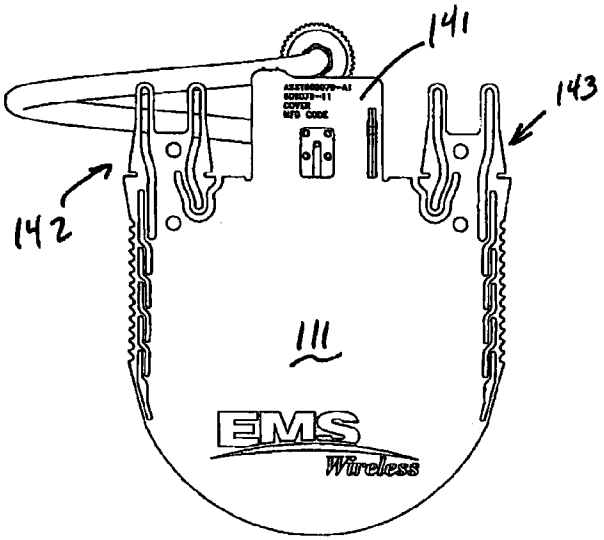

As described briefly above, the antenna element 111 has three finger-like portions, best seen in FIGS. 23A, 23C. These finger-like portions or elements include an inboard, somewhat broad finger 141 and two outboard, somewhat narrower fingers 142, 143. The outboard fingers are somewhat squeezable, using strain-relief slots. This feature, combined with shoulders formed in the antenna element 111 adjacent the fingers 142, 143, allows the antenna element to be releasably locked in place in the slots formed in the ground plate 116.

FIGS. 24A, 24B depict the antenna 110 as it would be configured upon installation in a ceiling (the ceiling itself is omitted from these figures for clarity).

Figure 25:
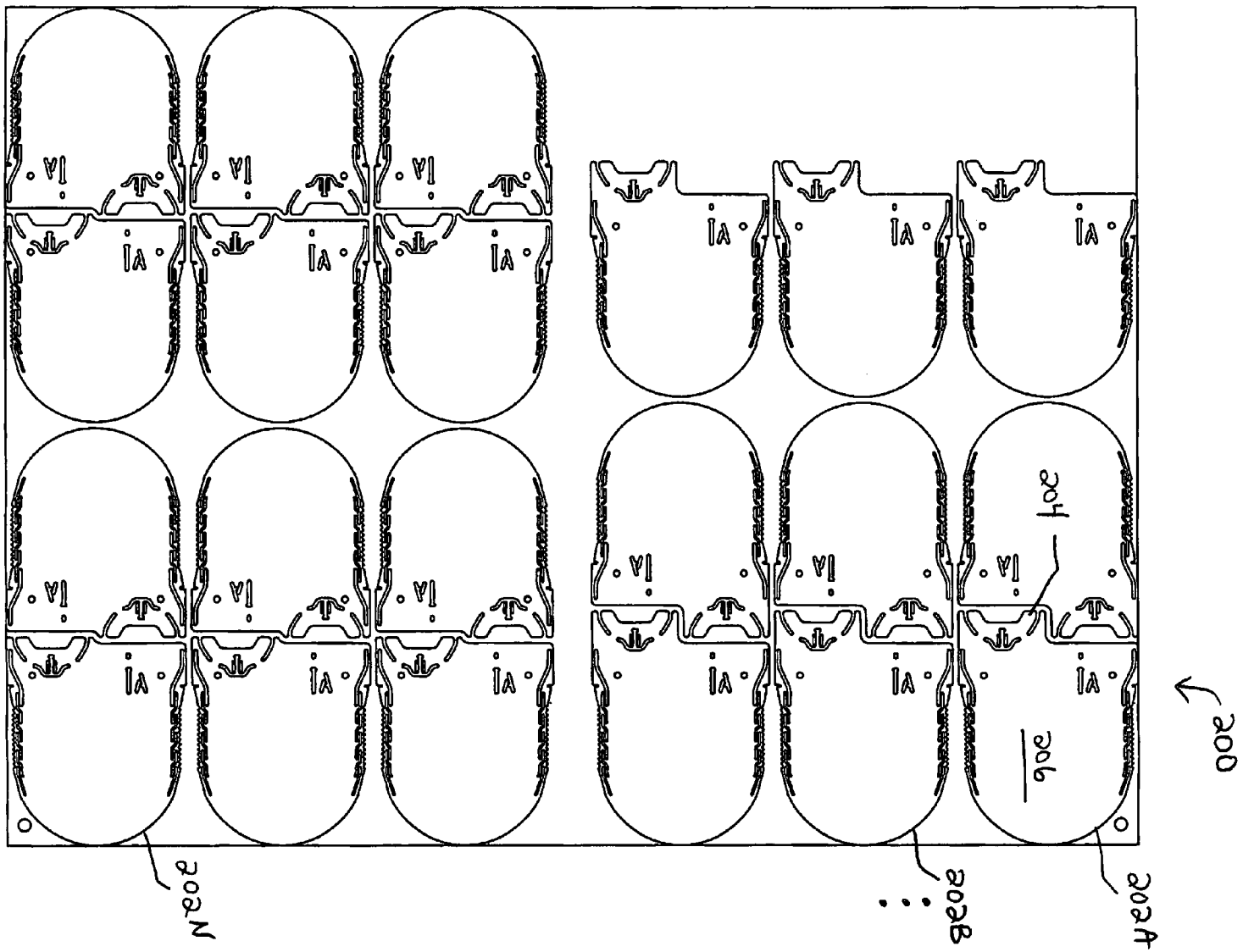
FIG. 25 shows a printed circuit board divided up into snap-apart panels in which each panel contains snap-apart pieces to assemble a wireless access point antenna.

FIG. 25 shows a printed circuit board sheet 200 divided up into snap-apart panels 202*a-n* in which each panel contains snap-apart pieces sufficient to assemble a wireless access point antenna fin antenna. The snap-apart pieces typically include a ground plate, a planar antenna element, a cross brace and a trim piece. As in the other embodiments, these fin antennas are configured for easy installation in a ceiling or ceiling tile. In addition, the fin antenna is configured for duplex communications in the carrier frequency ranges from 800 MHz through 2400 MHz, and within a coverage pattern below the ceiling extending through 360° azimuth and 180° elevation. The antenna elements dielectric substrate printed circuit board carrying printed conductor including a circular conductor disk radiating element, associated transmission signal paths, and printed indicia that typically include assembly instructions and a logo. The printed circuit board sheet configuration makes the fin antennas inexpensive to mass produce and easy to snap apart into individual units, which are themselves self-contained, easy to snap apart and install.

While the invention has been disclosed in preferred forms, those skilled in the art will recognize that many modifications, additions, and deletions can be made without departing from the spirit and scope of the invention as set forth in the following claims.

The invention claimed is:

1. An antenna configured for assembly in an operational configuration for indoor use in a building or other structure having a ceiling, the antenna comprising:

a ground plate configured to be positioned above an opening in the ceiling;

a substantially planar antenna board carrying a substantially planar radiating antenna element, the antenna board configured for connection to the ground plate with the antenna board positioned substantially perpendicular to the ground plate extending through the opening in the ceiling with the antenna element at least partially suspended below the ceiling; and the antenna configured for duplex communications within a coverage pattern below the ceiling extending through approximately 360° azimuth and 180° elevation when the antenna is assembled in the operational configuration.

2. The antenna of claim 1, wherein:

the ground plate comprises a slot for receiving the antenna board;

the antenna board is configured to be inserted through the slot; and the antenna board further comprises ratchet teeth and associated strain relief openings for engaging the slot to hold the antenna board to the ground plate.

3. The antenna of claim 1, further comprising a cross brace configured to be inserted into a slot through the antenna board substantially perpendicular to the antenna board, the cross brace configured to support the antenna board substantially perpendicular to the ground plate.

4. The antenna of claim 3, wherein:

the antenna board and the cross brace snap apart from a printed circuit board panel; and the antenna is configured for field assembly without tools other than those necessary to cut the opening in the ceiling.

5. The antenna of claim 1, wherein the antenna board further comprises:

a printed circuit monopole conductor radiating element sandwiched between two dielectric boards;

printed circuit transmission signal paths in electrical communication with the radiating element; and a coaxial cable connector in electrical communication with the printed circuit transmission signal paths.

6. The antenna of claim 5, wherein the antenna board further comprises a printed circuit secondary ground plate carried on an exterior surface of at least one of the dielectric boards.

7. The antenna of claim 1 wherein the antenna board further comprises printed indicia including assembly instructions for the antenna.

8. The antenna of claim 1, further comprising a trim piece configured to be located over a portion of the antenna board to at least partially conceal the opening in the ceiling when the antenna is assembled in the operational configuration.

9. The antenna of claim 1, configured for duplex communications in a carrier frequency range spanning at least an approximate 2:1 ratio from the highest frequency value to the lowest frequency value in the carrier frequency band when the antenna is assembled in the operational configuration.

10. The antenna of claim 2, configured for duplex communications in a carrier frequency range from approximately 800 MHz through 2400 MHz when the antenna is assembled in the operational configuration.

11. A printed circuit board sheet comprising:

a plurality of snap-apart panels, each panel containing snap-apart pieces including at least a planar antenna board carrying a substantially planar radiating antenna element and a planar cross brace configured for insertion into a slot through the antenna board;

the snap-apart pieces further configured assembly of an antenna in an operational configuration with the antenna board positioned substantially perpendicular to a ground plate located above a ceiling, the cross brace inserted through the sot and supporting the antenna board substantially perpendicular to the ground plate, and the antenna board extending from the ground plate through an opening in the ceiling with the antenna element least partially suspended below the ceiling; and the antenna configured for duplex communications within a coverage pattern below the ceiling extending through approximately 360° azimuth and 180° elevation when the antenna is assembled in the operational configuration.

12. The printed circuit board sheet of claim 11, wherein each panel is configured for use in field assembly of an associated antenna without tools other than those necessary to cut the opening in the ceiling.

13. The printed circuit board sheet of claim 11, wherein each antenna board contains a printed circuit monopole conductive radiating element sandwiched between two dielectric layers, associated printed circuit transmission signal paths in electrical communication with the radiating element, and printed indicia.

14. The printed circuit board sheet of claim 13, wherein the printed indicia includes instructions for assembling the antenna when the antenna is assembled in the operational configuration.

15. The printed circuit board sheet of claim 13, wherein each antenna board further comprises a coaxial cable connector in electrical communication with the printed circuit transmission signal paths.

16. The printed circuit board sheet of claim 11, wherein each antenna is configured for duplex communications within a carrier frequency range spanning at least an approximate 2:1 ratio from the highest frequency value to the lowest frequency value in the carrier frequency band when the antenna is assembled in the operational configuration.

17. The printed circuit board sheet of claim 11, wherein each antenna is configured for duplex communications within a carrier frequency range from approximately 800 MHz through 2400 MHz when the antenna is assembled in the operational configuration.

18. A method for installing a wireless access point antenna in an operational configuration in association with a ceiling comprising the steps of:

cutting an opening in the ceiling;

placing a ground plate having a slot over the opening in the ceiling;

attaching the planar antenna board to the ground plate and through the opening in the ceiling to suspend a substantially planar radiating antenna element carried by the antenna board at least partially below the ceiling.

19. The method of claim 18, further comprising the step of installing a trim piece over a portion of the antenna board to at least partially conceal the opening in the ceiling.

20. The method of claim 18, further comprising the steps of:

snapping apart parts from a flat panel comprising the at least the antenna board and a cross brace; and inserting the cross brace into a slot in the antenna board substantially perpendicular to the antenna board, in which position the cross brace supports the antenna board substantially perpendicular to the ground plate.

21. The method of claim 20, further comprising the step of configuring the antenna, when assembled in the operational configuration, for duplex communications within a carrier frequency range spanning at least an approximate 2:1 ratio of frequency value from the highest to the lowest frequency values in the carrier frequency band, and within a coverage pattern below the ceiling extending through approximately 360° and 180° elevation.

22. The method of claim 20, further comprising the step of configuring the antenna, when assembled in the operational configuration, for duplex communications within a carrier frequency range approximately from 800 MHz through 2400 MHz, and within a coverage pattern below the ceiling extending through approximately 360° and 180° elevation.

* * * * *